US009697809B2

(12) United States Patent
Cardozo

(10) Patent No.: US 9,697,809 B2
(45) Date of Patent: Jul. 4, 2017

(54) GUITAR TREMOLO BRIDGE

(71) Applicant: William Cardozo, Ketchum, ID (US)

(72) Inventor: William Cardozo, Ketchum, ID (US)

( * ) Notice: Subject to any disclaimer, the term of this patent is extended or adjusted under 35 U.S.C. 154(b) by 0 days.

(21) Appl. No.: 15/350,563

(22) Filed: Nov. 14, 2016

(65) Prior Publication Data

US 2017/0061941 A1 Mar. 2, 2017

Related U.S. Application Data

(63) Continuation of application No. 14/808,279, filed on Jul. 24, 2015, now Pat. No. 9,502,010.

(60) Provisional application No. 62/114,378, filed on Feb. 10, 2015, provisional application No. 62/078,295, filed on Nov. 11, 2014, provisional application No. 62/040,609, filed on Aug. 22, 2014.

(51) Int. Cl.

| | |
|---|---|
| ***G10D 3/14*** | (2006.01) |
| ***G10D 3/04*** | (2006.01) |
| ***G10D 1/08*** | (2006.01) |

(52) U.S. Cl.

CPC ..... *G10D 3/146* (2013.01); *G10D 1/085* (2013.01); *G10D 3/04* (2013.01)

(58) Field of Classification Search

CPC ..... G10D 3/146

See application file for complete search history.

(56) References Cited

U.S. PATENT DOCUMENTS

| | | | | | |
|---|---|---|---|---|---|
| 2,741,146 | A * | 4/1956 | Fender | G10D 3/146 | 84/313 |
| 2,781,685 | A * | 2/1957 | White | G10D 3/146 | 84/312 R |
| 2,897,709 | A * | 8/1959 | McCarty | G10H 3/182 | 84/173 |
| 2,960,900 | A * | 11/1960 | Fender | G10D 1/085 | 84/290 |
| 2,972,923 | A * | 2/1961 | Fender | G10D 3/146 | 84/267 |
| 3,237,502 | A * | 3/1966 | Moseley | G10D 3/14 | 224/264 |
| 3,241,418 | A * | 3/1966 | Fender | G10D 3/143 | 84/313 |
| 3,248,991 | A * | 5/1966 | Cole | G10D 3/12 | 84/313 |
| 3,382,749 | A * | 5/1968 | Watson | G10D 3/146 | 84/313 |
| 3,411,394 | A * | 11/1968 | Jones | G10D 3/146 | 84/313 |

(Continued)

*Primary Examiner* — Robert W Horn

(74) *Attorney, Agent, or Firm* — Buchanan Nipper LLC

(57) ABSTRACT

A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising: a base plate, a block extending from said base plate, a tremolo arm attached to said base plate, and a locking mechanism for locking the position of the tremolo bridge.

20 Claims, 17 Drawing Sheets

(56) References Cited

U.S. PATENT DOCUMENTS 3,424,049 A * 1/1969 Daniel ..... G10D 3/146 84/313
3,479,917 A * 11/1969 Zitnik, Jr. ..... G10D 3/143 84/312 R
4,171,661 A * 10/1979 Rose ..... G10D 3/146 84/297 R
4,341,144 A * 7/1982 Milne ..... G10D 3/04 84/299
4,383,466 A * 5/1983 Shibuya ..... G10D 3/146 84/313
4,453,443 A * 6/1984 Smith ..... G10D 3/12 84/205
4,475,432 A * 10/1984 Stroh ..... G10D 3/12 84/214
4,497,236 A * 2/1985 Rose ..... G10D 3/04 84/267
4,555,970 A * 12/1985 Rose ..... G10D 3/146 84/312 P
4,572,049 A * 2/1986 Tanaka ..... G10D 3/146 84/297 R
4,611,523 A * 9/1986 McFarland ..... G10D 3/143 84/267
4,648,304 A * 3/1987 Hoshino ..... G10D 3/146 84/297 S
4,655,116 A * 4/1987 Matsui ..... G10D 3/14 84/297 R
4,656,916 A * 4/1987 Gressett, Jr. ..... G10D 3/146 84/313
4,672,877 A * 6/1987 Hoshino ..... G10D 3/12 84/267
4,677,891 A * 7/1987 Gressett, Jr. ..... G10D 3/146 84/267
4,697,493 A * 10/1987 Ralston ..... G10D 3/146 84/313
4,724,737 A * 2/1988 Fender ..... G10D 3/146 84/297 R
4,869,145 A * 9/1989 Evans ..... G10D 3/146 84/313
4,892,025 A * 1/1990 Steinberger ..... G10D 3/146 84/313
4,903,568 A * 2/1990 Itoh ..... G10D 3/146 84/313
4,932,302 A * 6/1990 Saijo ..... G10D 3/146 84/313
4,939,971 A * 7/1990 Satoh ..... G10D 3/146 84/313
5,046,393 A * 9/1991 Xenidis ..... G10D 3/146 84/313
5,088,374 A * 2/1992 Saijo ..... G10D 3/146 84/313
5,088,375 A * 2/1992 Saijo ..... G10D 3/146 84/313
5,140,884 A * 8/1992 Bowden ..... G10D 3/14 84/297 R
5,196,641 A * 3/1993 Schaller ..... G10D 3/146 84/299
5,198,601 A * 3/1993 McCabe ..... G10D 3/146 84/298
5,260,511 A * 11/1993 Gregory ..... G10D 1/085 84/312 R
5,277,094 A * 1/1994 Spuler ..... G10D 3/12 84/298
5,305,675 A * 4/1994 Lasner ..... G10D 3/146 84/313
5,311,804 A * 5/1994 Wilkinson ..... G10D 3/143 84/313
5,373,769 A * 12/1994 Sherman ..... G10D 3/146 84/313
5,381,716 A * 1/1995 May ..... G10D 3/146 384/4
5,413,019 A * 5/1995 Blanda, Jr. ..... G10D 3/146 84/298
5,419,227 A * 5/1995 Lavineway ..... G10D 3/146 84/313
5,481,955 A * 1/1996 Goto ..... G10D 3/146 84/313
5,522,297 A * 6/1996 Enserink ..... G10D 3/146 84/313
5,522,298 A * 6/1996 Schaller ..... G10D 3/146 84/313
5,539,144 A * 7/1996 Sherman ..... G10D 3/146 84/267
5,747,713 A * 5/1998 Clement ..... G10D 3/146 84/313
5,783,763 A * 7/1998 Schaller ..... G10D 3/146 84/298
5,824,925 A * 10/1998 Yost ..... G10D 3/146 84/298
5,942,703 A * 8/1999 Boehnlein ..... G10D 3/146 84/313
5,986,190 A * 11/1999 Wolff ..... G10D 3/146 84/297 R
5,986,192 A * 11/1999 Wingfield ..... G10D 3/146 84/313
6,015,945 A * 1/2000 Borisoff ..... G10D 3/146 84/313
6,100,459 A * 8/2000 Yost ..... G10D 3/146 84/298
6,384,311 B1 * 5/2002 Cota ..... G10D 1/085 84/267
6,552,252 B2 * 4/2003 Hirayama ..... G10D 3/146 84/313
6,573,439 B2 * 6/2003 Wilson ..... G10D 3/146 84/290
6,812,389 B2 * 11/2004 Trooien ..... G10D 3/146 84/312 R
6,943,284 B2 * 9/2005 Didan ..... G10D 3/146 84/312 R
7,145,065 B2 * 12/2006 Geier ..... G10D 3/146 84/313
7,259,309 B1 * 8/2007 Lovelace ..... G10D 3/146 84/313
7,329,808 B2 * 2/2008 Davis ..... G10D 3/143 84/298
7,339,102 B2 * 3/2008 Folmar ..... G10D 3/146 84/313
7,427,703 B2 * 9/2008 Geier ..... G10D 3/146 84/307
7,446,248 B2 * 11/2008 Skinn ..... G10D 3/143 84/312 R
7,531,731 B2 * 5/2009 Longo ..... G10D 3/146 84/312 R
7,541,528 B2 * 6/2009 Lyles ..... G10D 3/12 84/312 R
7,557,282 B2 * 7/2009 Holdway ..... G10D 3/146 84/294
7,663,038 B2 * 2/2010 Stadler ..... G10D 3/04 84/307
7,692,079 B2 * 4/2010 Lyles ..... G10D 3/14 84/312 R
7,745,709 B2 * 6/2010 Benjamin ..... G10D 3/146 84/313
7,842,869 B2 * 11/2010 Adams ..... G10D 3/04 84/297 R
7,855,330 B2 * 12/2010 Lyles ..... G10D 3/04 84/297 R
7,888,571 B2 * 2/2011 Steinberger ..... G10D 3/146 84/267
8,017,844 B2 * 9/2011 Steinberger ..... G10D 3/146 84/298
8,252,999 B2 * 8/2012 Deck ..... G10D 3/14 84/313
8,344,231 B2 * 1/2013 Hamilton ..... G10D 3/04 84/297 R
8,536,430 B2 * 9/2013 McCabe ..... G10D 3/14 84/312 R
8,536,431 B1 * 9/2013 McCabe ..... G10D 3/146 84/298

(56) References Cited

U.S. PATENT DOCUMENTS

| | | | | |
|---|---|---|---|---|
| 9,029,671 | B1 * | 5/2015 | Smith | G10D 3/146 84/313 |
| 9,330,638 | B2 * | 5/2016 | Maslarov | G10D 3/146 |
| 9,330,639 | B1 * | 5/2016 | Armstrong | G10D 3/146 |
| 9,502,010 | B1 * | 11/2016 | Cardozo | G10D 3/146 |
| 2006/0005687 | A1 * | 1/2006 | Minakuchi | G10D 3/146 84/313 |
| 2008/0072735 | A1 * | 3/2008 | Kahler | G10D 3/146 84/313 |
| 2011/0036228 | A1 * | 2/2011 | Deck | G10D 3/146 84/313 |
| 2011/0072952 | A1 * | 3/2011 | Koyama | G10D 3/146 84/313 |
| 2013/0047816 | A1 * | 2/2013 | Rukavina | G10D 3/146 84/313 |
| 2013/0291705 | A1 * | 11/2013 | Rose | G10D 3/146 84/297 R |

* cited by examiner

GUITAR TREMOLO BRIDGE

TECHNICAL FIELD

The disclosure generally relates to the field of stringed musical instruments. Particular embodiments relate to electric guitars.

BACKGROUND

Traditionally, guitars have a headstock opposite a tail. The head includes a headpiece having tuning pegs to which the first ends of the guitar strings attach. The strings extend along a fretboard to the body of the guitar where, at their second ends, they mount to a bridge which, typically, extends generally perpendicular to the length of the strings. In such a configuration, the bridge has a front side which is nearer to the head of the guitar, and a rear side which is nearer to the tail of the guitar. In such a guitar, the bridge is rigidly mounted to the body of the guitar.

In roughly 1954, Fender Guitar Corp. patented a new design for a guitar bridge used with an electric guitar, a design commonly referred to as a "fulcrum-style tremolo bridge." A fulcrum-style tremolo bridge allows a guitar player to raise and lower the pitch of the strings by pulling up on, or pushing down on, a tremolo arm that is attached to the bridge. In a fulcrum-style tremolo bridge, a first side of the bridge is held in tension against the body of the guitar, wherein the bridge can pivot at its contact point with the body. In one such type fulcrum-style tremolo bridge, referred to as a Wilkenson bridge, the front side of the bridge has a blade edge which is held in tension against a pair of posts mounted to the body of the guitar, and the bridge is able to pivot at the connection between the blade edge and the posts (described infra). In another fulcrum-style tremolo bridge, the tremolo bridge pivots based on a number of fasteners (e.g., screws) which extend through the front portion of the tremolo bridge and into the body.

The embodiments discussed herein are discussed relative to such a Wilkenson bridge. For instance, using language like "at least one post extending from said body, each of said at least one post further comprising a V-shaped notch." However, such language is intended to include other such floating bridges, including the original fender "six hole" fulcrum bridge wherein the bridge attaches loosely to the body of the guitar using screws, and it is the contact with the screws that serves as the pivotal connection that is the equivalent to the edge pivoting in the V-shaped notch of a post described herein.

In a fulcrum-style tremolo bridge, in general, the rear side of the bridge "floats" and is not mounted to the body of the guitar. The bridge further includes a block attached to the bottom of the bridge which passes through the guitar. Attached to this block are springs that run forward from the block toward the neck of the guitar. The springs counterbalance the tension of the strings of the guitar, holding the strings of the guitar in tune in a default position where the strings' tension is generally equal to springs' tension. In such a configuration, the bridge can pivot upwards and downwards generally around an axis that is defined by the point where the blade edge of the bridge contacts the posts of the body.

When the guitar is in tune, the bridge lies somewhere between the limits of the distance that it can pivot. When the rear side of the bridge pivots upwards (away from the body of the guitar), the pitch of the strings is lowered; whereas when the rear side of the bridge pivots downwards (towards the body of the guitar), the pitch of the strings is raised.

A traditional fulcrum-style tremolo bridge has a commonly known limitation that occurs when the guitar player bends a string to raise its pitch. When one string is bent, the tension generated by bending the string overcomes the opposing tension from the springs, and the rear side of the bridge will pivot upwards (away from the body of the guitar). This pivoting motion may result in the pitch of all of the strings changing (not just the string bent). Further, this pivoting motion may result in the pitch of the strings changing unequally. For instance, when the bridge is pivoted all of the guitar's strings change equally in length but change unequally in pitch. This occurs due to the difference in each string's diameter. Thus, even a relatively small pivoting motion results in a pitch change across multiple strings. Because of this, a problem exists for a guitarist who may want to play other notes or chords on the other strings while the bent string is bent.

SUMMARY OF THE DISCLOSURE

Several exemplary guitar tremolo bridges are described herein.

A first exemplary tremolo bridge comprises a tremolo arm and locking mechanism. The tremolo arm is capable of being rotated into a locked position and an unlocked position. When in the locked position, the locking mechanism fixes the guitar's bridge in its then-current position relative to the guitar. Conversely, when the tremolo arm is rotated into an unlocked position, the guitar's bridge can tilt freely.

Optionally, the locking mechanism further comprises a pressure pin and body plate. The body plate is fixed to the guitar's body and the pressure pin is operably attached to the tremolo arm by a cam member and boss. When the tremolo arm is rotated into its locked position, the cam member engages the boss, thus extending the pressure pin along an axis and making contact with the body plate. When this contact is made, the guitar's bridge is fixed in its then-current position.

The locking mechanism further comprises a biasing portion for biasing the pressure pin in an opposite direction. In this configuration, when the tremolo arm is rotated into its unlocked position, the pressure pin retracts along the same axis and disengages the body plate. Thus, the guitar's bridge can tilt freely.

A second exemplary tremolo bridge comprises a tremolo arm, a sensor, an electronic actuator and a locking system, further comprised of a brake rod and brake portion; the brake rod extends through the brake portion. The tremolo arm is capable of being rotated into a locked and an unlocked position, which triggers the sensor. When in the locked position, the sensor electronically signals the electronic actuator. Upon being signaled, the actuator engages the locking system. When engaged, the brake portion engages the brake rod thus fixing the guitar's bridge in its then-current position. Conversely, rotation of the tremolo arm in a second direction disengages the locking system, allowing for the guitar's bridge to tilt freely.

Optionally, the locking mechanism can be triggered by a switch that is part of a replacement potentiometer which replaced one of the existing potentiometers (e.g., volume, tone) on the guitar.

Optionally, the brake can be activated by a servo, solenoid, or other electro-mechanical mechanism.

A third exemplary guitar tremolo bridge comprises a tremolo arm and locking system, further comprised of a brake rod and brake system; the brake rod extends through the brake portion. The tremolo arm is capable of being rotated into a locked and an unlocked position, which locks the bridge in its then-current position. The tremolo arm is operatively connected to the locking mechanism such that when the arm is rotated into its locked position, the brake system engages the brake rod. In such a configuration, the guitar's bridge is held in its then-current position. Conversely, rotation of the tremolo arm in a second direction disengages the locking system, allowing for the guitar's bridge to tilt freely.

Optionally, the locking mechanism comprises a brake portion, sensor, and electronic actuator. The brake portion configured so that a brake rod is attached to the guitar's bridge and runs through a brake. When the tremolo arm is rotated into its locked position the sensor notifies the electronic actuator, via an electronic signal. When the electronic actuator is notified it engages the brake, thus clamping down on the brake rod. In this position, the guitar's bridge is fixed in its then-current position.

When the tremolo arm is rotated into its unlocked position, the sensor notifies the electronic actuator, via an electronic signal and the brake is disengaged. In this position, the guitar's bridge can tilt freely.

A third exemplary tremolo bridge comprises a tremolo arm, tremolo axle, and locking mechanism. The tremolo arm is operably attached to the tremolo axle and is rotatable between a locked and an unlocked position. When the tremolo arm is rotated into its locked position, the tremolo axle engages the locking mechanism, further comprised of a pressure pin and body plate. The body plate is fixed to the guitar's body and the pressure pin is operably attached to the tremolo axle by a cam member and boss. When the tremolo arm is rotated into its locked position, the tremolo axle enables the cam member to engage the boss, thus extending the pressure pin along an axis and making contact with the body plate. When this contact is made, the guitar's bridge is fixed in its then-current position.

The locking mechanism further comprises a biasing portion for biasing the pressure pin in an opposite direction. In this configuration, when the tremolo arm is rotated into its unlocked position, the tremolo axle retracts the pressure pin along the same axis and disengages the body plate. Thus, the guitar's bridge can tilt freely.

A fourth exemplary tremolo bridge comprises a tremolo arm, sensor, electronic actuator, and locking system. The tremolo arm is capable of being rotated into a locked and an unlocked position. When in the locked position, the locking mechanism fixes the guitar's bridge in its then-current position relative to the guitar. Conversely, when the tremolo arm is rotated into an unlocked position, the guitar's bridge can tilt freely.

The locking mechanism further comprises a brake portion, sensor, and electronic actuator. The brake portion configured so that a brake rod is attached to the guitar's bridge and runs through a brake. When the tremolo arm is rotated into its locked position the sensor notifies the electronic actuator, via an electronic signal. When the electronic actuator is notified it engages the brake, thus clamping down on the brake rod. In this position, the guitar's bridge is fixed in its then-current position.

When the tremolo arm is rotated into its unlocked position, the sensor notifies the electronic actuator, via an electronic signal and the brake is disengaged. In this position, the guitar's bridge can tilt freely.

Additional understanding of the devices and methods contemplated and/or claimed by the inventor(s) can be gained by reviewing the detailed description of exemplary devices and methods, presented below, and the referenced drawings.

DETAILED DESCRIPTION

Figure 1:
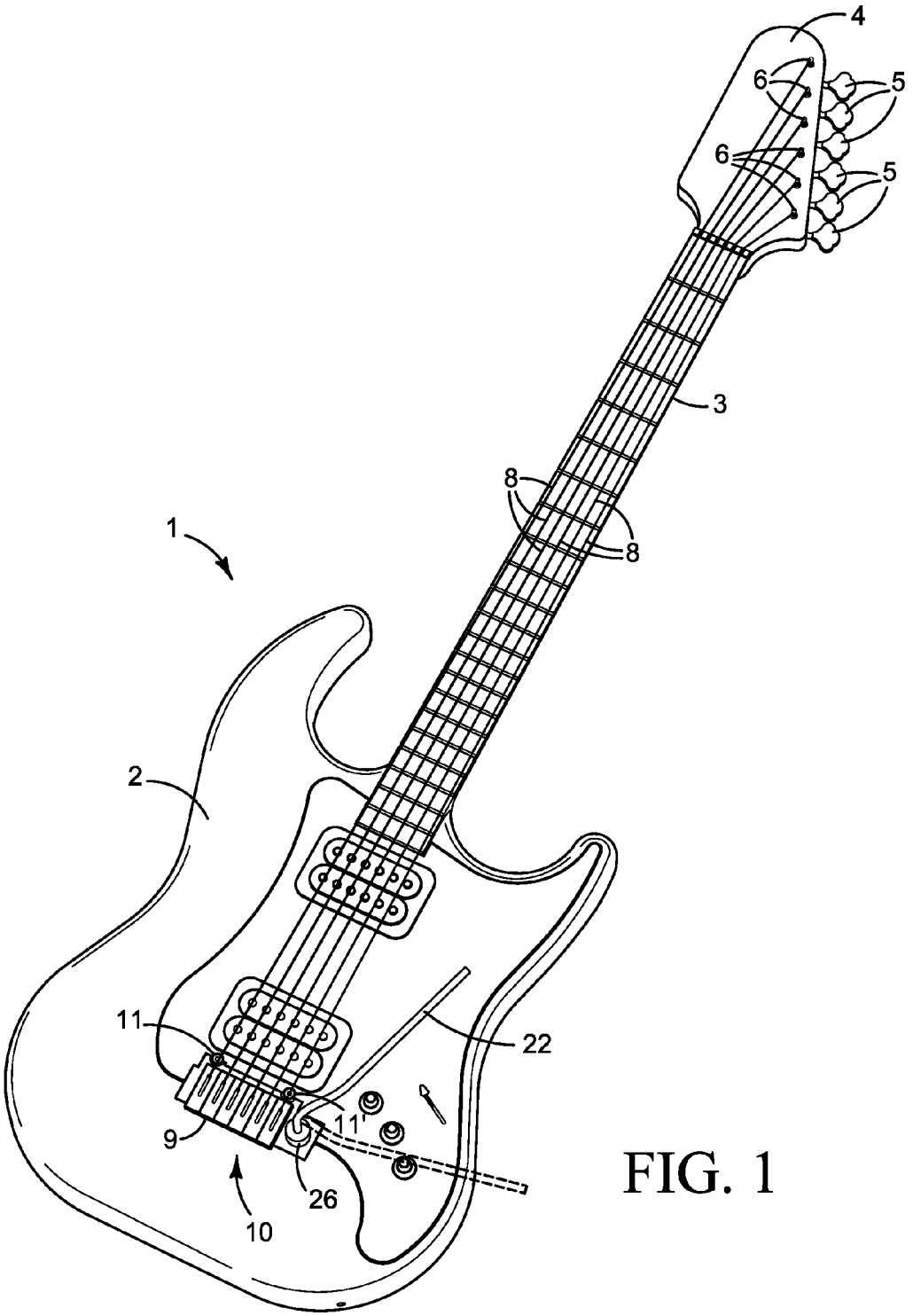
FIG. 1 is a top perspective view of a guitar having a first exemplary guitar tremolo bridge.
Figure 2:
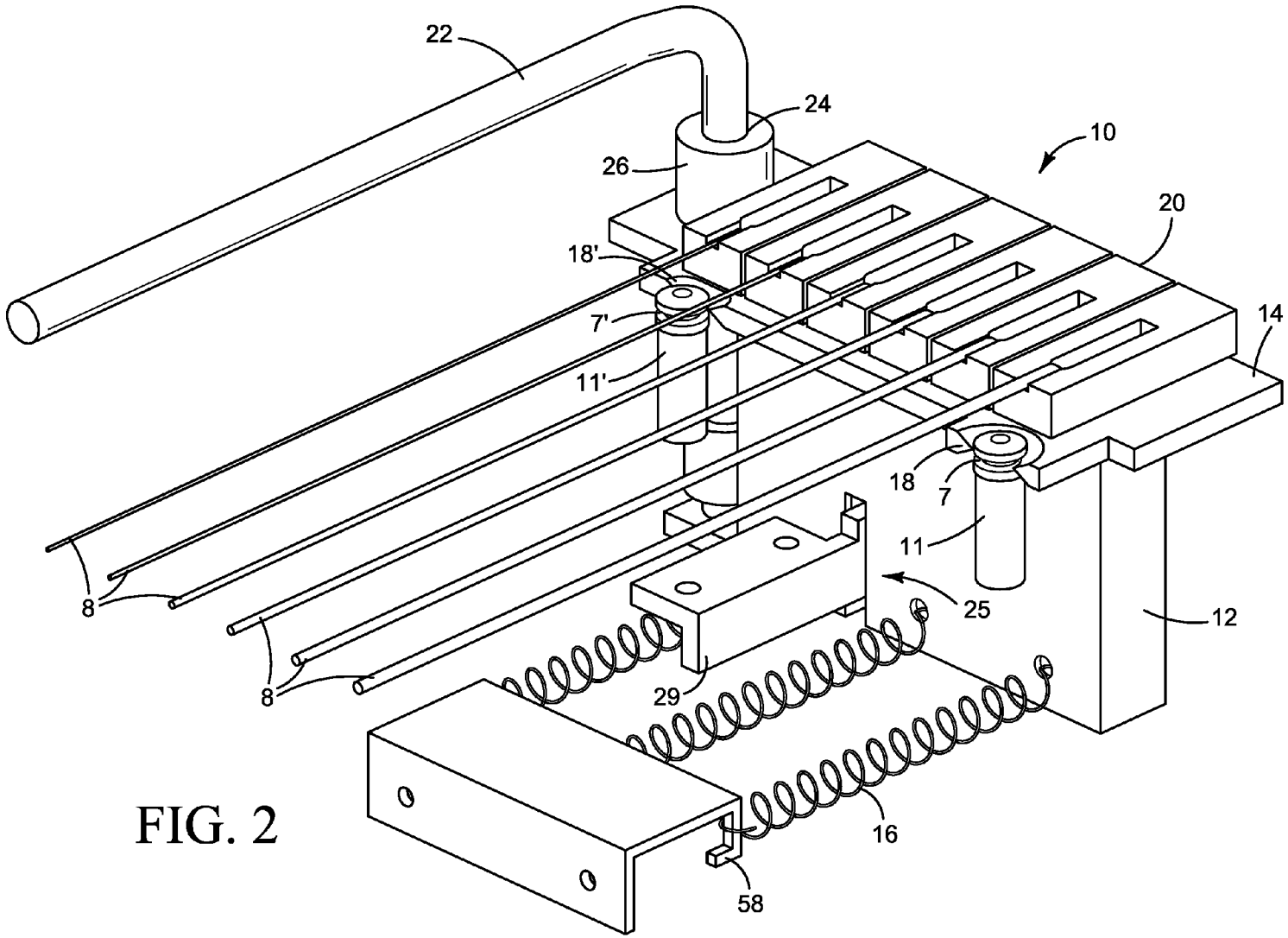
FIG. 2 is a partial, first side top perspective view of the first exemplary guitar tremolo bridge.

The following description and the referenced drawings provide illustrative examples of that which the inventor regards as his invention. As such, the embodiments discussed herein are merely exemplary in nature and are not intended to limit the scope of the invention, or its protection, in any manner. Rather, the description and illustration of these embodiments serve to enable a person of ordinary skill in the relevant art to practice the invention.

The use of "e.g.," "etc," "for instance," "in example," "for example," and "or" and grammatically related terms indicates non-exclusive alternatives without limitation, unless otherwise noted. The use of "including" and grammatically related terms means "including, but not limited to," unless otherwise noted. The use of the articles "a," "an" and "the" are meant to be interpreted as referring to the singular as well as the plural, unless the context clearly dictates otherwise. Thus, for example, reference to "a pressure pin" includes two or more such pressure pins, and the like. The use of "optionally," "alternatively," and grammatically related terms means that the subsequently described element, event or circumstance may or may not be present/occur, and that the description includes instances where said element, event or circumstance occurs and instances where it does not. The use of "preferred," "preferably," and grammatically related terms means that a specified element or technique is more acceptable than another, but not that such specified element or technique is a necessity, unless the context clearly dictates otherwise. The use of "exemplary" means "an example of" and is not intended to convey a meaning of an ideal or preferred embodiment.

The use of "sensor" means any device that performs a measurement of its environment and transmits a signal regarding that measurement, including but not limited to, optical sensors (e.g., optical detectors, optical eyes (e.g., CCD or LED sensor/receiver combinations)), proximity sensors, photoelectric sensors, magnetic sensors, and infrared sensors, unless context clearly dictates otherwise.

The use of "tremolo arm" means a mechanism that allows the user to quickly vary the tension, and sometimes length, of the guitar's strings temporarily, unless the context clearly dictates otherwise. This motion changes the guitar's pitch to create a vibrato, portamento, or pitch bend effect.

The use of "pressure pin" means a device configured to engage and disengage the guitar's bridge, keeping it in a fixed or floating position, unless the context clearly dictates otherwise.

The use of "body plate" means a surface configured to engage said pressure pin, enabling the guitar's bridge to remain in a fixed or floating position, unless the context clearly dictates otherwise.

The use of "electronic actuator" means a self-contained actuator that converts electrical energy to mechanical energy to cause motion, unless the context clearly indicates otherwise. Examples of electronic actuator s include, but are not limited to, an electric motor that drives a mechanical rod through a mechanism such as a screw thread to cause motion, a solenoid, servos, and motors.

A number of exemplary guitar tremolo bridges are disclosed herein. While fulcrum-style guitar tremolo bridges are envisioned as the likely use of such devices, it may also be able to be used on other guitars with a tremolo bridge.

Referring initially to FIGS. 1 through 8, a first exemplary guitar tremolo bridge 10 is illustrated in general schematic format. The guitar tremolo bridge 10 is configured for use with a guitar 1 comprising a body 2, a neck 3 attached to said body 2, a headstock 4 attached to said neck 3, a plurality of tuners 5 disposed on said headstock 4 and adjacent the neck 3, at least one post 11 extending from said body 2, each of said at least one post 11, 11' further comprising a V-shaped notch 7, 7' (illustrated in FIG. 2), and a plurality of strings 8, whereby each string of said plurality of strings 8 is attached to the guitar tremolo bridge 10, extends along the neck 3 of the guitar 1, and is attached to a corresponding one of said plurality of tuners 5 disposed on the headstock 4.

The guitar tremolo bridge 10 is mounted to the body 2. The front side of the guitar tremolo bridge 10 has a blade edge 18 that is held in tension against a pair of posts 11, 11' mounted to the body 2 of the guitar 1 by the strings 8 and at least one spring 16. The guitar tremolo bridge 10 is able to pivot at the connection between the blade edge 18 and the posts 11 through use of a tremolo arm 22. While the exemplary guitar tremolo bridges described herein are fulcrum-style tremolo bridges, a skilled artisan will be able to select an appropriate style tremolo bridge for use as the tremolo bridge in a particular embodiment based on various considerations, including the intended use of the tremolo bridge, the intended arena within which the tremolo bridge will be used, and the equipment and/or accessories with which the tremolo bridge is intended to be used, among other considerations.

The guitar tremolo bridge 10 can be utilized in a free-floating position and in a fixed position. In the free-floating position (illustrated in FIGS. 3, 4, 5 and 7), the guitar tremolo bridge 10 is able to pivot at the connection between the blade edge 18 and the posts 11. Thus, the rear side 9 of the guitar tremolo bridge 10 "floats" and is not fixed in position relative to the body 2 of the guitar 1. Conversely, in the fixed position (illustrated in FIGS. 6 and 8), the locking mechanism 26 is engaged to fix the guitar tremolo bridge 10 in position relative to the body 2 of the guitar 1.

Figure 3:
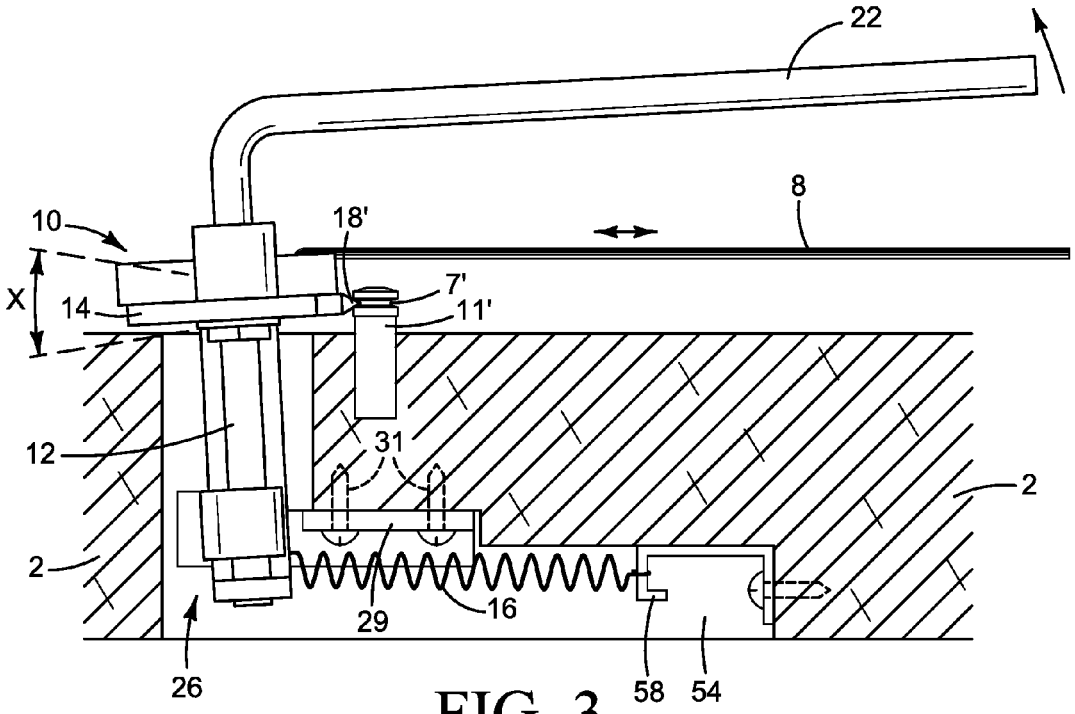
FIG. 3 is a partial, cross-sectional elevation view of the first exemplary guitar tremolo bridge.
Figure 4:
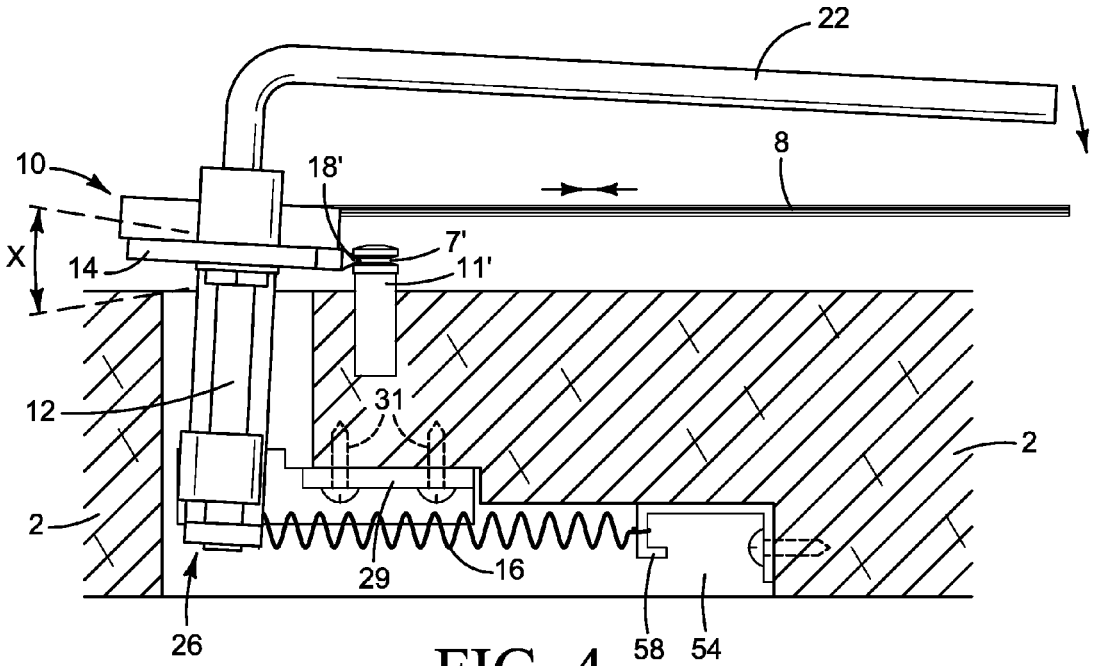
FIG. 4 is a partial, cross-sectional elevation view of the first exemplary guitar tremolo bridge.

The guitar tremolo bridge 10 comprises a block 12 and a base plate 14. The block 12 extends into the body 2 of the guitar 1 and connects to the body 2 of the guitar 1 via a plurality of springs 16. The base plate 14 comprises a blade edge 18 that is configured for receipt into a V-shaped notch 7, 7' and "floats" via a connection to the two posts 11, 11'. The base plate 14 has a rear side 20 opposite the blade edge 18. The guitar's strings 8 attach to the guitar tremolo bridge 10, and extend to the headstock 4 of the guitar 1. In such a configuration, the rear side 20 of the base plate 14 can be moved upwards or downwards along an arc X, as illustrated in FIGS. 3 and 4.

The guitar tremolo bridge 10 further comprises a tremolo arm 22. The tremolo arm 22 configured for attaching to the block 12 at a connection point 24. The tremolo arm 22 is preferably freely rotatable about the connection point 24. The tremolo arm 22 providing a lever which a guitar player can manipulate to move the rear side 20 of the base plate 14 of the guitar tremolo bridge 10 upwards and downwards along the arc X. Rotation of the tremolo arm 22 causes rotation of a shaft 13 extending downwards from the connection point 24.

Figure 5:
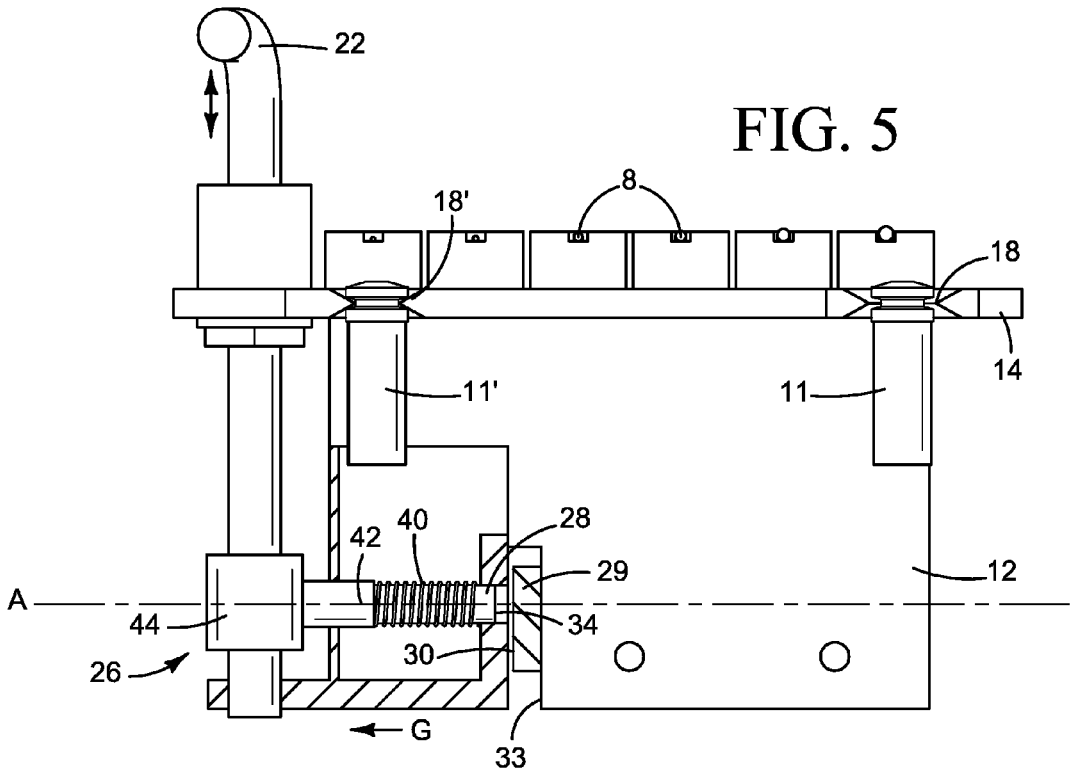
FIG. 5 is a partial, cross-sectional front view of the first exemplary guitar tremolo bridge.
Figure 6:
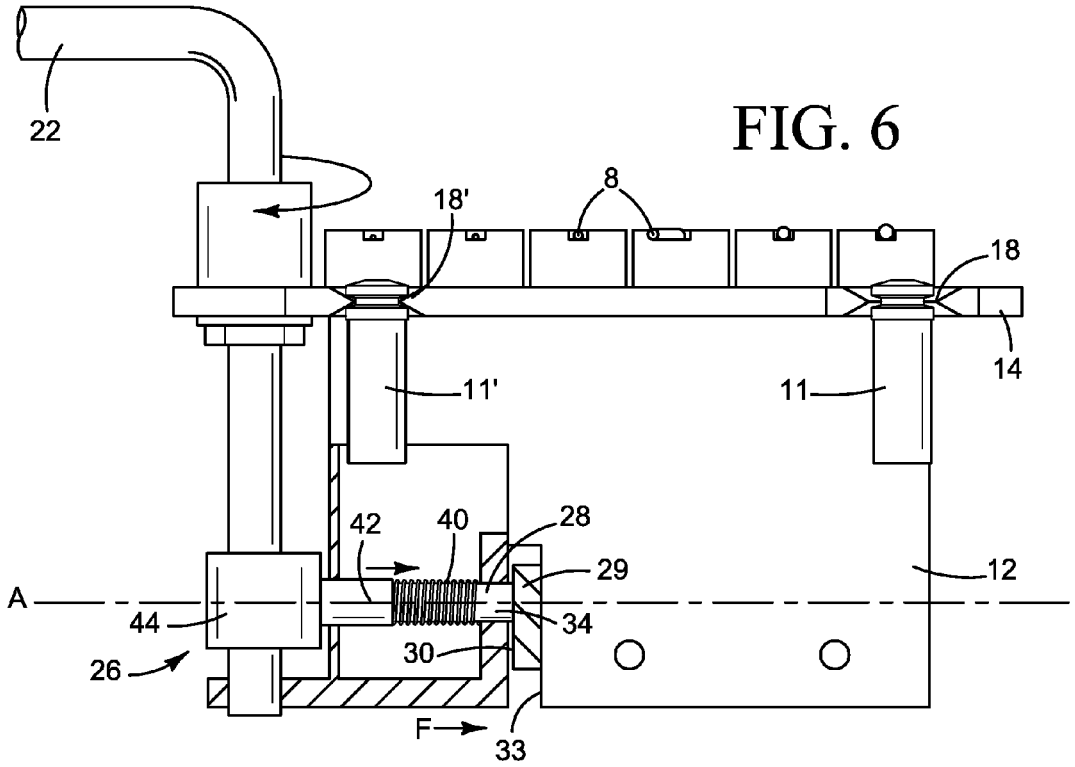
FIG. 6 is a partial, cross-sectional front view of the first exemplary guitar tremolo bridge.
Figure 8:
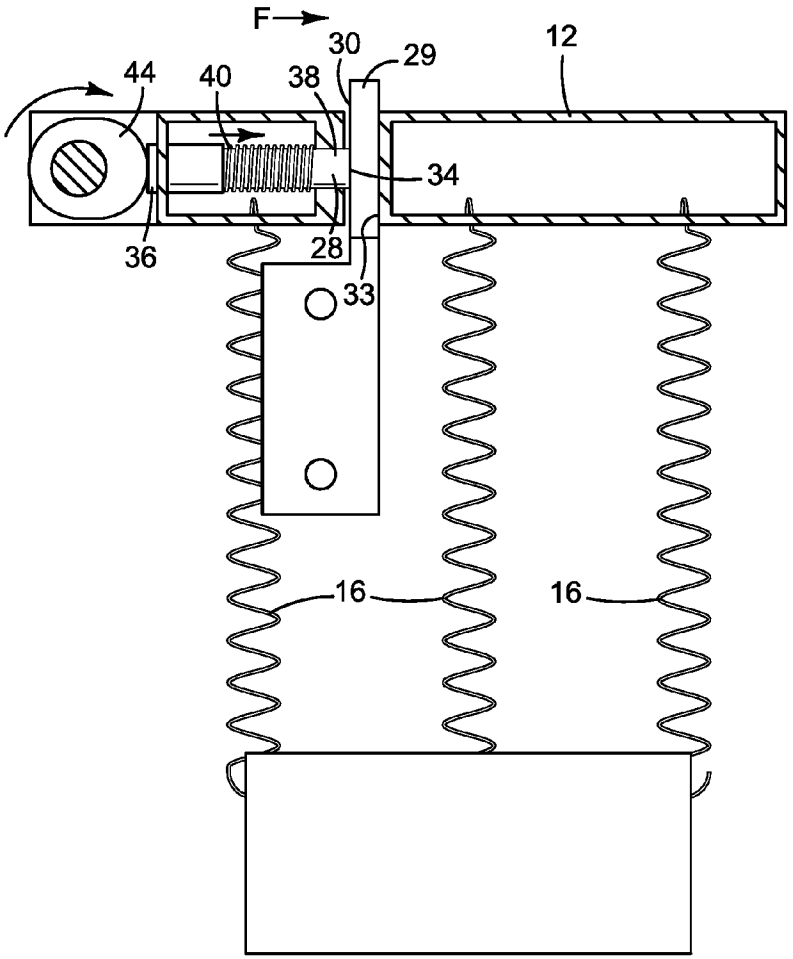
FIG. 8 is a partial, bottom schematic view of the first exemplary guitar tremolo bridge.
Figure 7:
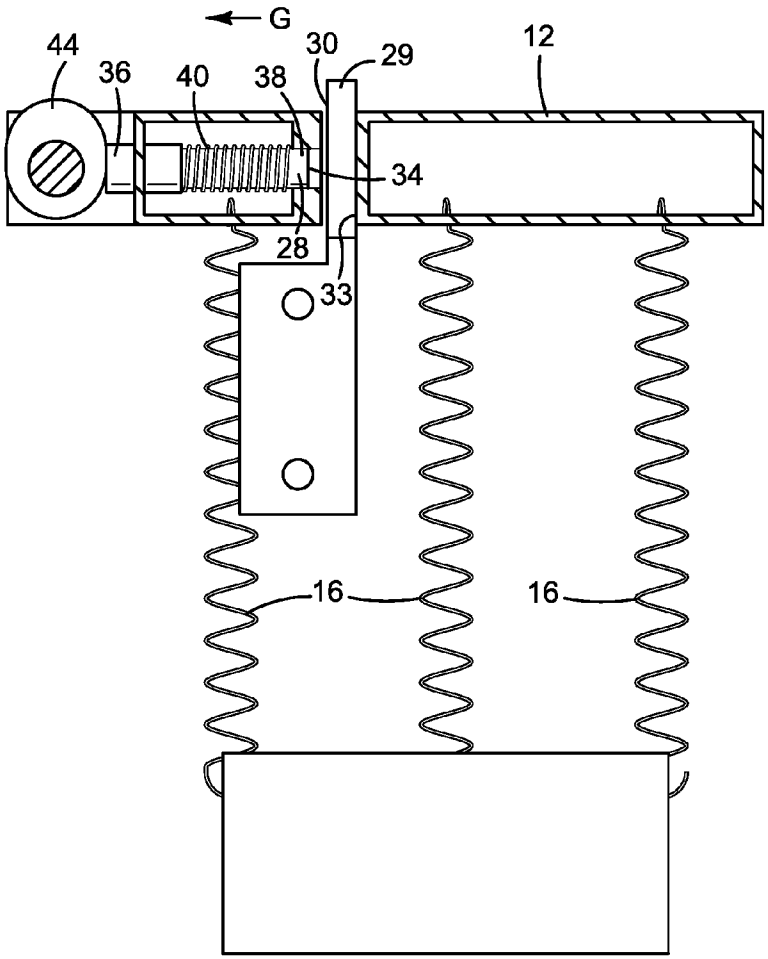
FIG. 7 is a partial, bottom schematic view of the first exemplary guitar tremolo bridge.

Connected to the tremolo arm 22 is a locking mechanism 26 for locking the guitar tremolo bridge 10 in position relative to the body 2 of the guitar 1 along the arc X. The tremolo arm 22 is rotatable between an unlocked position and a locked position. As illustrated in FIG. 6, when the tremolo arm 22 is rotated so that the locking mechanism 26 is in its locked position, the guitar tremolo bridge 10 is locked and held in its then-current position relative to the body 2. Conversely, when the tremolo arm 22 is rotated so that the locking mechanism 26 is in its unlocked position, as illustrated in FIGS. 3, 4, and 5, the guitar tremolo bridge 10 is capable of tilting freely along the defined arc X.

By fixing the guitar tremolo bridge 10 in its then-current position relative to the body 2, a change in string tension (i.e., an intentional bend to the string, or broken string) of one string does not cause the rest of the strings to go out of tune. This allows players to do all of the "Nashville double stops" they want without tuning issues. If the player wants to later use the guitar tremolo bridge 10, they can rotate the tremolo arm 22 back to its unlocked position, and the locking mechanism 26 is disengaged.

In the first exemplary guitar tremolo bridge 10 illustrated in these figures, the locking mechanism 26 can further comprises a body plate 29. The body plate 29 configured for attachment to the body 2 of the guitar 1, for instance through fasteners 31, as illustrated in FIGS. 3 and 4. The body plate 29 is thereby fixed in position relative to the guitar tremolo bridge 10.

The locking mechanism 26 further comprises a pressure pin 28. In the first exemplary guitar tremolo bridge 10 illustrated in FIGS. 5 and 6, the pressure pin 28 extends through the block 12. The pressure pin 28 has an axis A defined as running through its midpoint which is generally parallel to the body of the pressure pin 28. The pressure pin 28 is configured for movement in a first direction F towards the contact surface 30, and in a second direction G away from the contact surface 30. The pressure pin 28 comprises a first end 36 extending to a second end 38, wherein the second end 38 comprises a tip 34.

The body plate 29 defines a contact surface 30 generally perpendicular to the pressure pin 28 axis A. In FIGS. 5 and 6, the contact surface 30 comprises the side of the body plate 29. The body plate 29 is configured for receipt between the tip 34 of the pressure pin 28 and a contact surface 30 of the block 12. It is preferred that the contact surface 30 be generally perpendicular to the pressure pin 28 axis A.

Preferably, the second end 38 comprises a locking portion 32. When the tremolo arm 22 is rotated into its locked position illustrated in FIG. 6, the guitar tremolo bridge 10 is held in its then-current position by compression between the tip 34 of the pressure pin 28 against the contact surface 30. The pressure pin 28 is extended to meet the contact surface 30 through the use of a spring 40 operatively connected to the tremolo arm 22 and pressure pin 28. Conversely, when the tremolo arm 22 is rotated into its unlocked position, the compressive force is removed, and the spring 40 returns the pressure pin 28 to its retracted position, thus the guitar tremolo bridge 10 is able to tilt freely.

Preferably, the first end 36 of the pressure pin 28 can comprise a boss 42, and the locking mechanism 26 can comprise a cam member 44 on the shaft 13 configured for manipulation by the tremolo arm 22. The cam member 44 is configured to engage the boss 42, wherein rotation of the tremolo arm 22 into its locked position rotates the shaft 13 and causes the cam member 44 to engage the boss 42. Upon the cam member 44 engaging the boss 42, a spring 40 extends the pressure pin 28 in the first direction F. This movement causes the guitar tremolo bridge 10 to be locked in its then-current position. Conversely, when the tremolo arm 22 is rotated into its unlocked position, the cam member 44 disengages from the boss 42 and the spring 40 retracts the pressure pin 28. Thus, the guitar tremolo bridge 10 is able to tilt freely.

Referring now to FIGS. 9 through 13, the second exemplary guitar tremolo bridge 110 is illustrated. The second exemplary guitar tremolo bridge 110 is similar to the first exemplary guitar tremolo bridge 10 illustrated in FIGS. 1 through 8 and described above, except as detailed below. Thus, the second exemplary guitar tremolo bridge 110 includes a base plate 114, a blade edge 118, a rear side 120, a tremolo arm 122, and a locking system 125.

In the second exemplary guitar tremolo bridge 110, the locking system 125 comprises an electronic locking mechanism 127. In the second exemplary guitar tremolo bridge 110, the electronic locking mechanism 127 comprises a brake rod 146 connecting to the block 112, and a brake portion 148 attached to the body 102 of the guitar 101. The electronic locking mechanism 127, based on an electrical charge (or absence thereof) or based on a signal received (or absence thereof), comprises a brake portion 148 that clamps or otherwise restricts the movement of the brake rod 146. The use of "rod" within "brake rod 146" is not intended to serve as a limitation on the shape of the brake rod 146, which may be rod shaped, elongated, a flange, a tab, or other such suitable structure.

Figure 9:
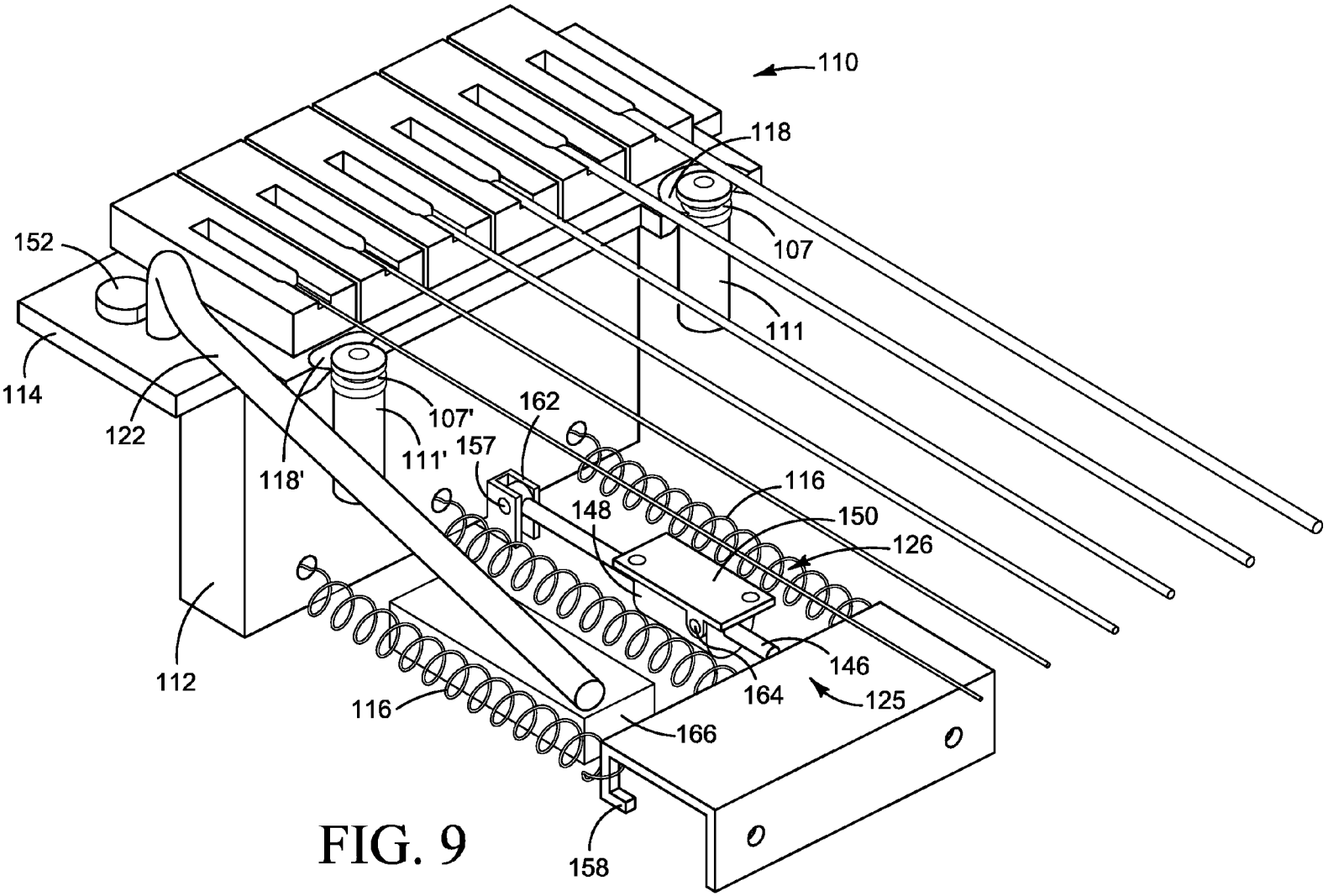
FIG. 9 is a partial, second side top perspective view of a second exemplary guitar tremolo bridge.

The electronic locking mechanism 127 illustrated in FIG. 9 is located in the tremolo recess 154 defined in the back side of the body 2 of the guitar 101. For instance, the electronic locking mechanism 127 could be located in one of the unused tremolo spring slots 55 (the counter-balance springs) in the tremolo recess 154.

The electronic locking mechanism 127 could be activated a number of different ways, including the ways discussed herein. A skilled artisan will be able to select an appropriate activation manner for the electronic locking mechanism in a particular embodiment based on various considerations, including the intended use of the electronic locking mechanism, the intended arena within which the electronic locking mechanism and tremolo will be used, and the equipment and/or accessories with which the electronic locking mechanism and tremolo is intended to be used, among other considerations.

Figure 10:
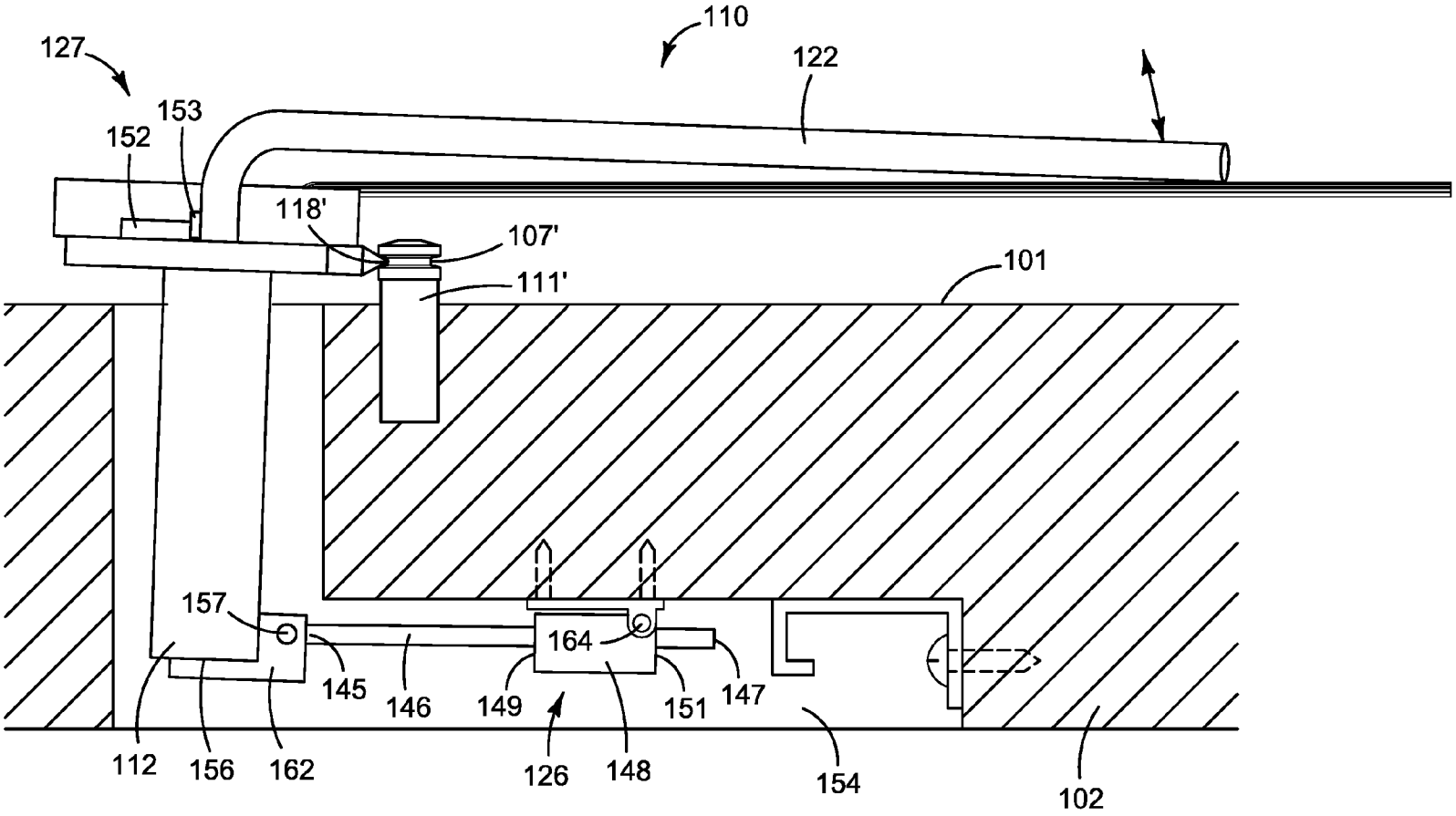
FIG. 10 is a partial, side cross-sectional view of the second exemplary guitar tremolo bridge.
Figure 11:
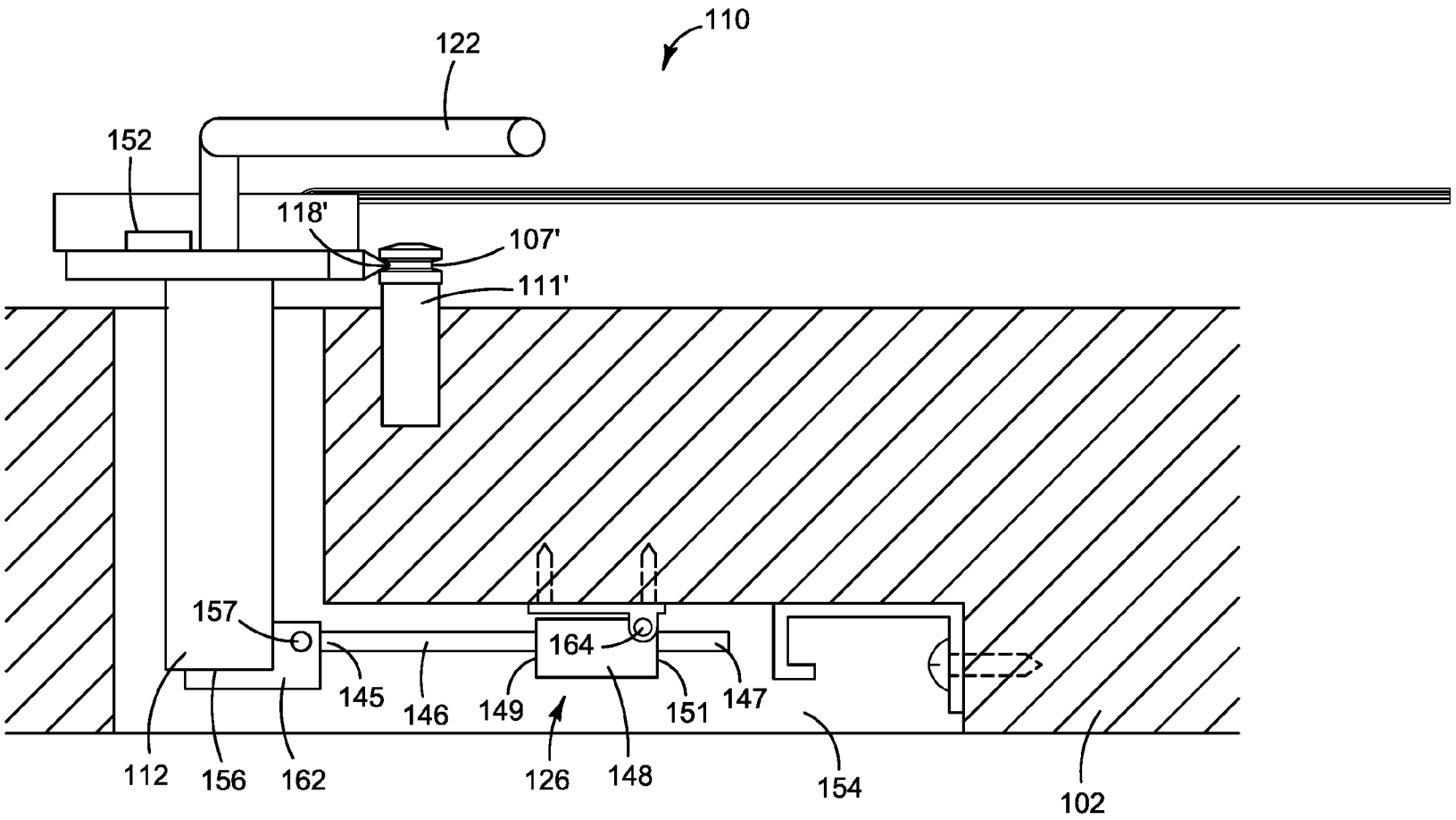
FIG. 11 is a partial, side cross-sectional view of the second exemplary guitar tremolo bridge.
Figure 12:
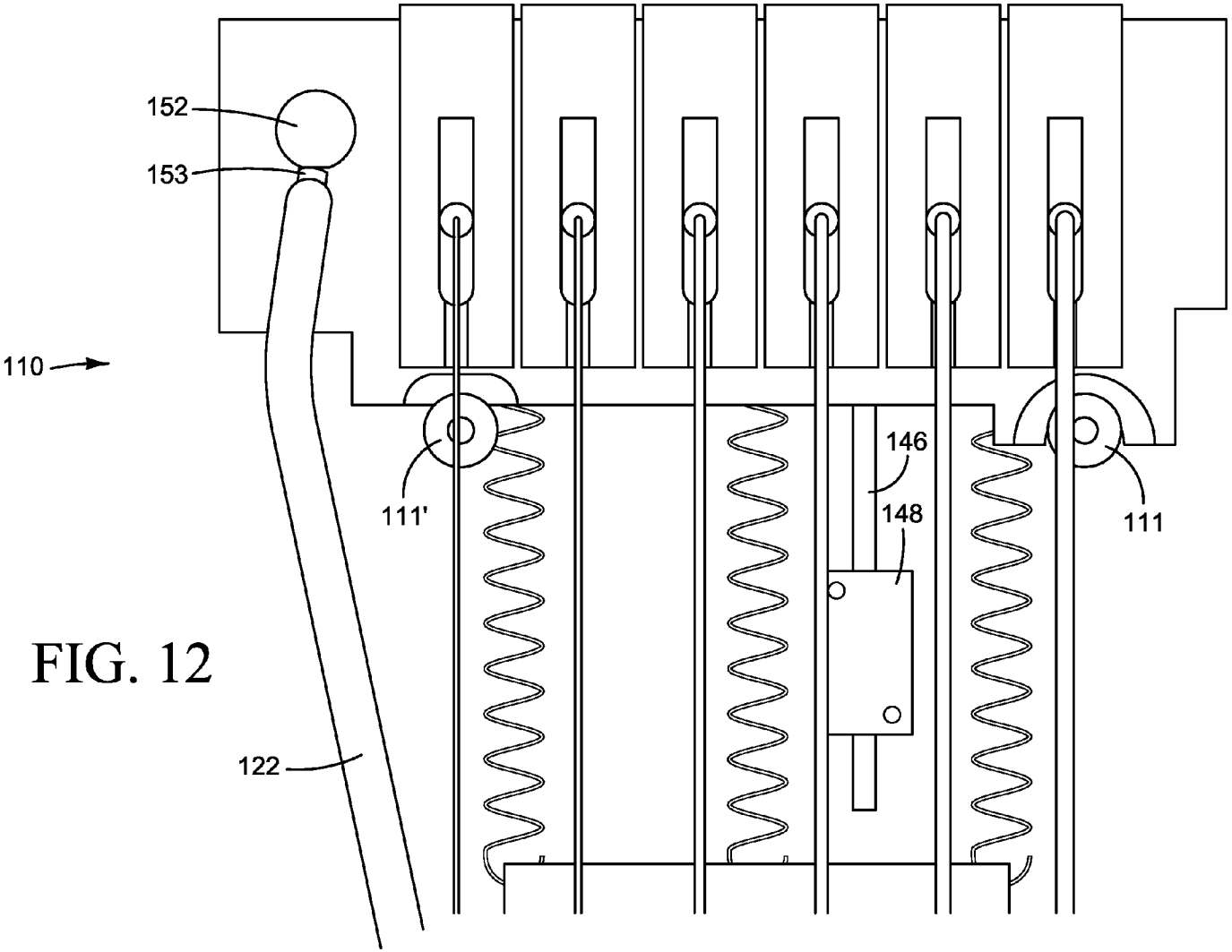
FIG. 12 is a partial, top plan view of the second exemplary guitar tremolo bridge.
Figure 13:
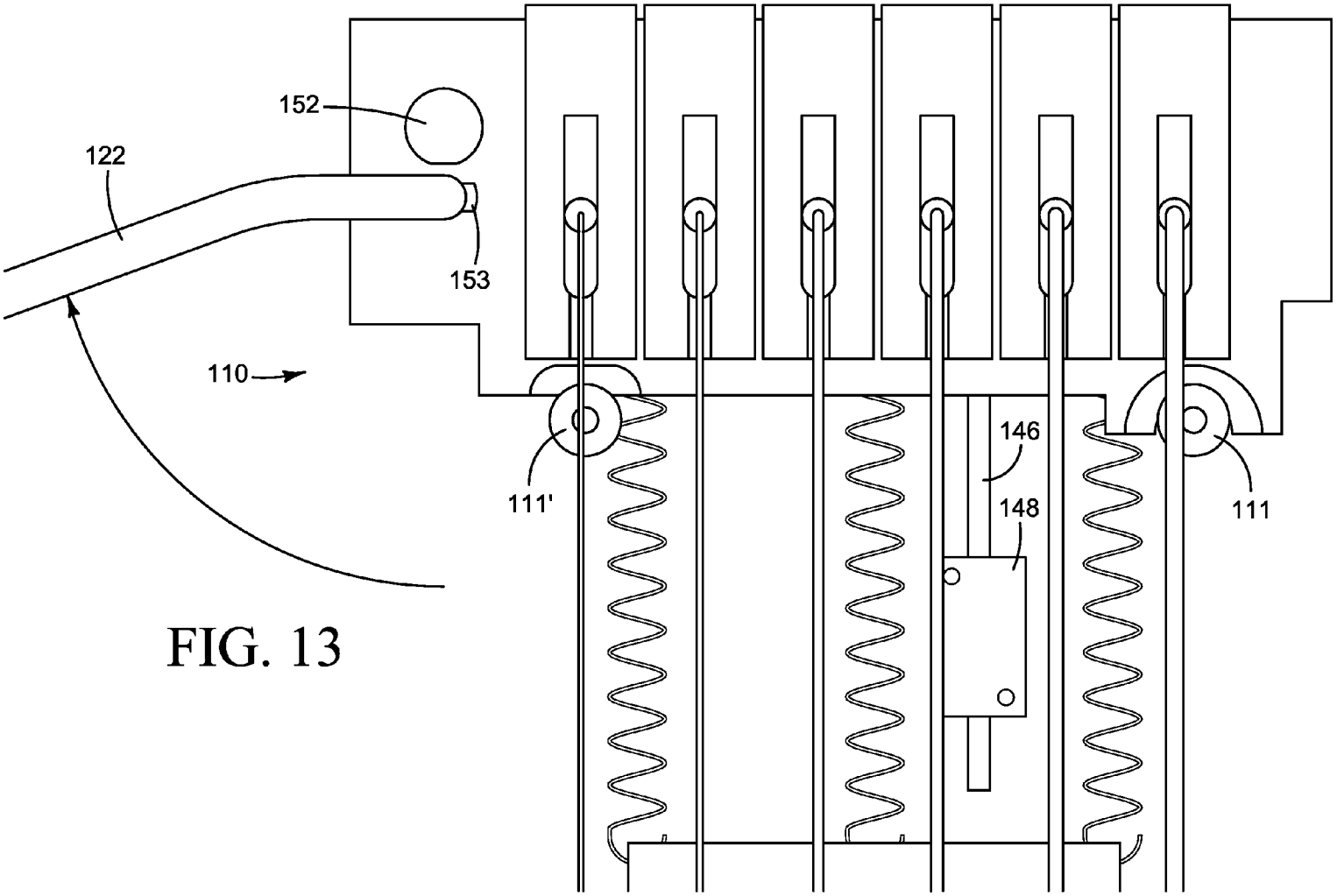
FIG. 13 is a partial, top plan view of the second exemplary guitar tremolo bridge.

Referring to FIG. 10, the electronic locking mechanism 127 comprises a connector 156 attaching to the block 112. A brake rod 146 is elongated, having a first end 145 and a second end 147. The brake rod 146 hingedly connects at its first end 145 with the connector 156 via a pivot 157. The second end 147 located distally from the block 112, preferably extending towards the claw 158 of the guitar 101. The brake rod 146 slidably extends through a brake portion 148, enabling the brake rod 146 to slide forward in a first direction F, and backward in a second direction G, along the longitudinal axis A of the brake rod 146. The brake portion 148 is configured for braking the slidable movement of the brake rod 146 therethrough and locking the brake rod 146 in place.

It is preferred that the electronic locking mechanism 127 comprise an electronic actuator 150 for actuating the brake portion 148, thereby locking the brake rod 146 in place. In the embodiment illustrated in FIG. 10, the brake portion 148 comprises a first portion 149 hingedly connected to a second portion 151, wherein the electronic actuator 150 comprises a solenoid 159 configured for moving the first portion 149 closer to the second portion 151, thereby clamping the brake portion 148 on the brake rod 146 extending therethrough, and moving the first portion 149 away from the second portion 151, thereby unclamping the brake portion 148 from the brake rod 146 and allowing the brake rod 146 to slide freely therethrough. Optionally, the brake portion 148 could be pivotally connected to the body 2 of the guitar 101 at a hinge connector 160.

The electronic actuator 150 could be activated through any suitable manner, including through use of switches, levers, and/or sensors. A skilled artisan will be able to select an appropriate manner of activating the electronic actuator in a particular embodiment based on various considerations, including the intended use of the tremolo bridge, the intended arena within which the tremolo bridge will be used, and the equipment and/or accessories with which the tremolo bridge is intended to be used, among other considerations. For instance, a sensor 152 could be mounted on the guitar 101 or guitar tremolo bridge 110. In the exemplary guitar tremolo bridge 110 illustrated in FIG. 9, sensor 152 is mounted on the guitar tremolo bridge 110 and the tremolo arm 122 such that when the tremolo arm 122 is moved in a first direction F the sensor 152 sends a signal to the electronic actuator 150 causing the electronic actuator 150 to engage the brake portion 148, locking the brake rod 146 therein and fixing the then-current position of the guitar tremolo bridge 110. Conversely, the tremolo arm 122 can be moved in a second direction G and the sensor 152 send a signal to the electronic actuator 150 to release the brake portion 148, unlocking the brake rod 146 and allowing it to slide therethrough, thereby allowing the guitar tremolo bridge 110 to tilt freely. Alternatively, the locking action could be controlled by triggering a switch that is part of a replacement potentiometer, replacing one of the existing ports on the guitar.

Further, the brake portion 148 can be activated by the electronic actuator 150 such that when the brake is activated or deactivated, no power is needed for the brake portion 148 to maintain its position. This improves battery life and such embodiment can be installed to a guitar without any modification.

Figure 14:
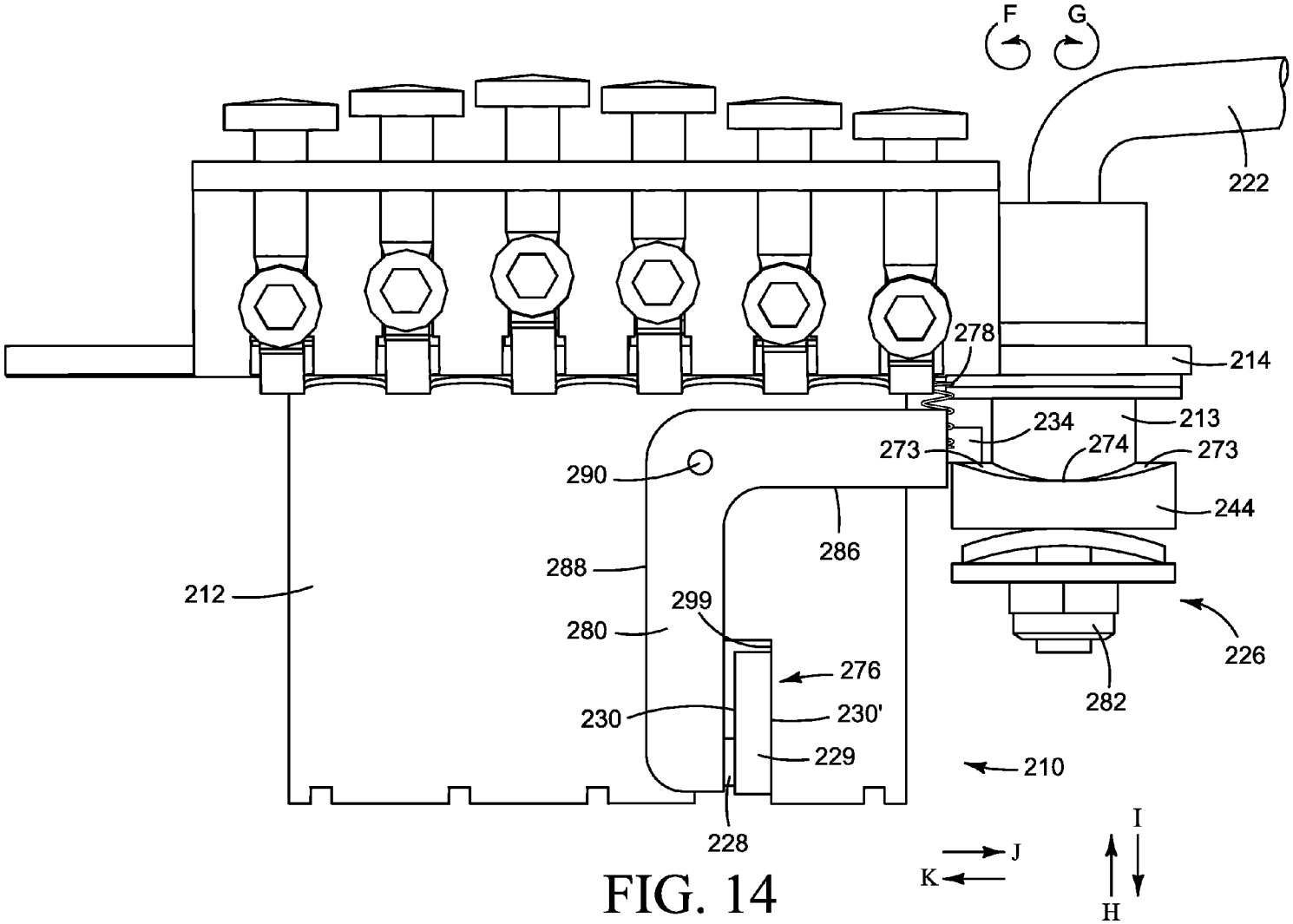
FIG. 14 is a partial, rear side view of a third exemplary guitar tremolo bridge.
Figure 15:
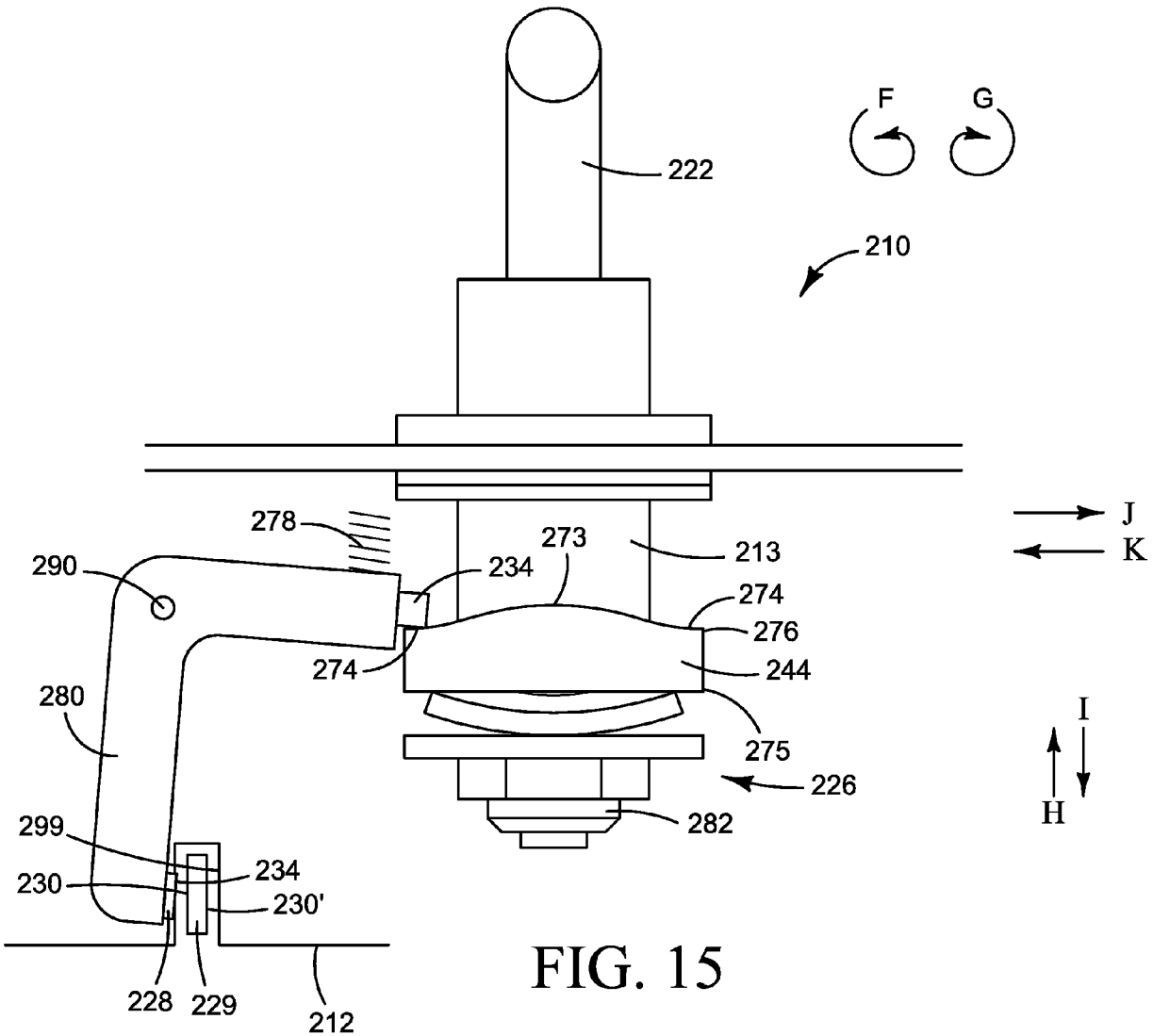
FIG. 15 is a partial, side elevation view of the third exemplary guitar tremolo bridge of FIG. 14 illustrating the unlocked position.
Figure 16:
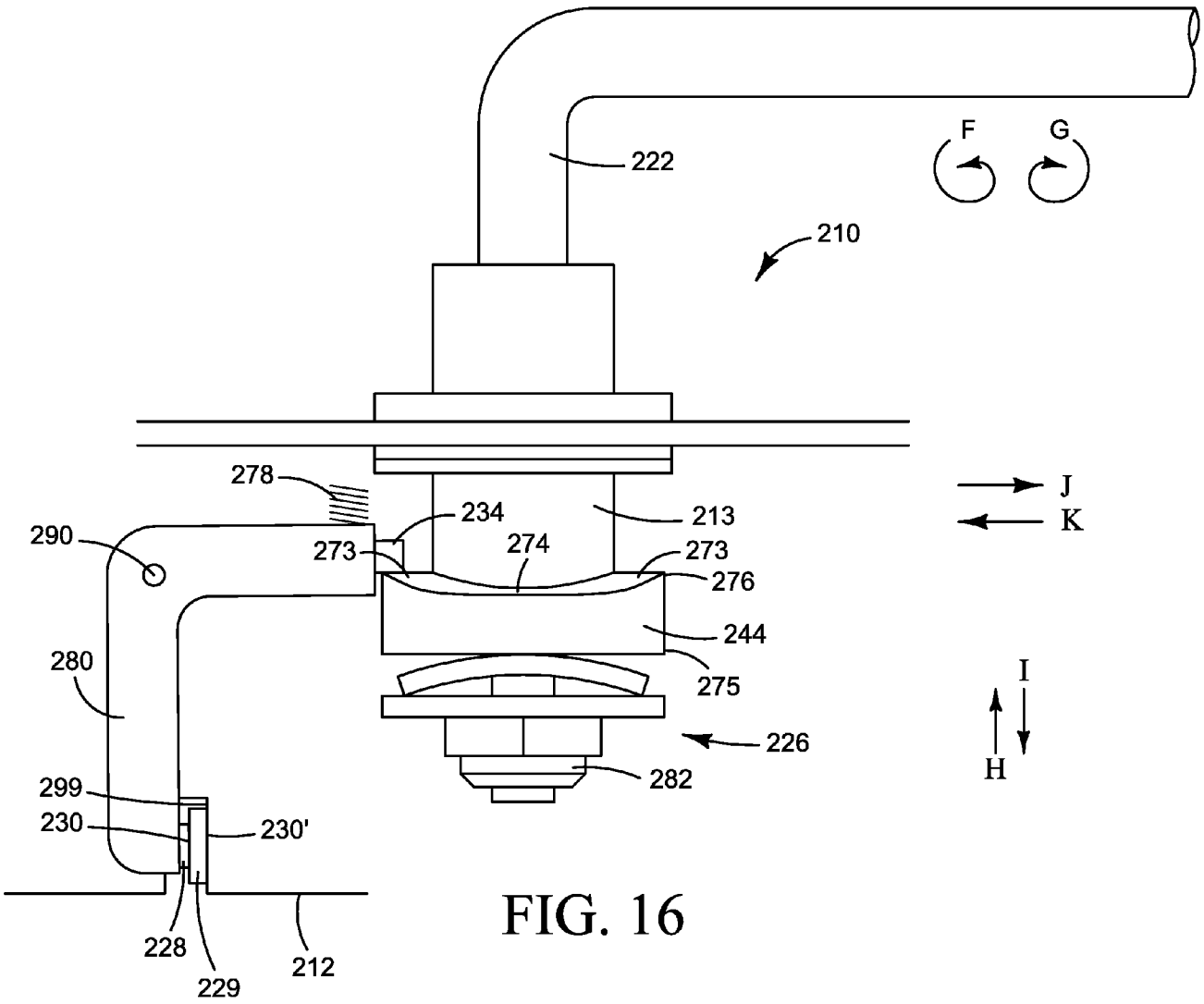
FIG. 16 is a partial, side elevation view of the third exemplary guitar tremolo bridge of FIG. 14 illustrating the locked position.

Referring now to FIGS. 14 through 16, the third exemplary guitar tremolo bridge 210 is illustrated. The third exemplary guitar tremolo bridge 210 is similar to the first exemplary guitar tremolo bridge 10 illustrated in FIGS. 1 through 8 and described above, except as detailed below. Thus, the third exemplary guitar tremolo bridge 210 includes a tremolo bridge 210, block 212, a shaft 213, a base plate 214, a tremolo arm 222, a locking mechanism 226, a pressure pin 228, a body plate 229, a contact surface 230, a tip 234, and a cam member 244.

The locking mechanism 226 for locking the guitar tremolo bridge 210 in position relative to the body of the guitar along the arc which the guitar tremolo bridge 210 is configured to pivot. The tremolo arm 222 is rotatable between an unlocked position and a locked position. As illustrated in FIGS. 15 and 16, when the tremolo arm 222 is rotated so that the locking mechanism 226 is in its locked position (FIG. 16), the guitar tremolo bridge 210 is locked and held in its then-current position relative to the body. Conversely, when the tremolo arm 222 is rotated so that the locking mechanism 226 is in its unlocked position (FIG. 15), the guitar tremolo bridge 210 is capable of tilting freely along the defined arc. The body plate 229 attaches to the body of the guitar, and is fixed in position relative to the guitar tremolo bridge 210.

The locking mechanism 226 further comprises a pivot arm 280 having a first leg 286 comprising a tip 234 and a second leg 288 comprising a pressure pin 228, and a cam member 244 attached about the shaft 213. Rotation of the tremolo arm 222 causes rotation of the shaft 213 and rotation of the cam member 244.

The cam member 244 is generally circular in shape when viewed from a top perspective, having an end cam shape, and is located about the shaft 213 such that rotation of the tremolo arm 222 and shaft 213 rotates the cam member 244. The cam member 244 comprises a top planar surface, which serves as a contact point for the tip 234 when the tremolo arm 222 is in its engaged position. Furthermore, the cam member 244 comprises a rise 273, and a dwell 274, which also serve as a contact point for the tip 234. The rise 273 serves as a contact point when the tremolo arm 222 is in its engaged position, and the dwell 274 serves as a contact point when the tremolo arm 222 is in its disengaged position. Thus, when viewed from a side perspective, the cam member 244 is an elongated "U" shape. The cam member 244 having a first side 276 which is proximal to the tremolo arm 222, and a second side 275 which is distal from the tremolo arm 222.

The body plate 229 defines a first contact surface 230, 230'. In FIGS. 14 through 16, the contact surface 230 comprises a first side of the body plate 229, and the contact surface 230' comprises a second side of the body plate 229. The body plate 229 is configured for receipt between the tip 234 of the pressure pin 228 and a block contact surface 399.

The pivot arm 280 comprises a tip 234 for engaging with the cam member 244, dwell 274, and rise 273. The tip 234 extends from the pivot arm 280 such that rotation of the tremolo arm 222 rotates the shaft 213 which, in turn, rotates the cam member 244. This rotation causes the tip 234 to either engage the rise 273 or the dwell 274. When the tip 234 is engaged with the dwell 274, the pivot arm 280 is disengaged from the body plate 229. This allows the tremolo bridge 210 to free-float. Conversely, when the tip 234 is engaged with the rise 273, the pivot arm 280 engages the body plate 229, causing the tremolo bridge 210 to be fixed in its then-current position.

The pivot arm 280 comprises a first leg 286 and second leg 288. The arm is preferably "L" shaped, having a tip 234 extending from its first leg 286. Further, the second leg 288 comprises a pressure pin 228 extending therefrom. The pivot arm 280 is pivotally mounted to the block 212 by a pivoted connection 290, allowing the pivot arm 280 to "rock"; vertical movement of the first leg 286 causes horizontal movement of the second leg 288 and horizontal movement of the second leg 288 causes vertical movement of the first leg 286. Thus, when exerting an upward vertical force on the tip 234 the second leg 288 extends in a first horizontal direction, affixing the pressure pin 228 to the body plate 229.

When the tremolo arm 222 is rotated in a first direction F the shaft 213, too, is rotated in a first direction F. This movement rotates the cam member 244 such that it either supports the tip 234 attached to the first leg 286 of the pivot arm 280 at its dwell 274, or the tip 234 rests in the rise 273. When, as illustrated in FIG. 16, the tip 234 is supported by the cam member 244 on the rise 273, an upward vertical force H is exerted upon the tip 234, causing a horizontal reaction by the pressure pin 228 in a first horizontal direction J. This horizontal force J causes the pressure pin 228 to come into contact with contact surface 230 of the body plate 229, forcing the contact surface 230' of the body plate 229 against the block contact surface 299, locking the tremolo bridge 210 in its then-current position. Conversely, as illustrated in FIG. 15, when the tremolo arm 222 is rotated in a second direction G the shaft 213, too, is rotated in a second direction G. This movement rotates the cam member 244, causing the tip 234 to rest in the dwell 274. In this configuration, a downward vertical force I (biased by spring 278) is exerted on the tip 234, causing a horizontal reaction by the pressure pin 228 in a second horizontal direction K. This horizontal reaction K causes the pressure pin 288 to retract from the body plate 229, allowing the tremolo bridge 210 to float freely.

A spring 278 is located between the back side of the pivot arm 280 and the block 212. As the cam member 244 is rotated by the tremolo arm 222 and shaft 213, the spring exerts a downward force I on the tip 234. This downward force I causes the tip 234 to be secured in place, whether resting upon the rise 273 of the cam member 244 or within the dwell 274.

Located adjacent the guitar's body plate 229 is an adjustable shoe 276. The adjustable shoe 276 acts as a surface against which the body plate 229 is clamped and can be moved in a first direction towards body plate 229 and in a second direction away from the body plate 229. By moving the adjustable shoe 276 in its first direction, the tremolo arm 222 must be rotated a greater amount in order for the pivot arm 280 to contact the body plate 229. Conversely, when the adjustable shoe 276 is rotated in its second direction, the tremolo arm 222 must be rotated a lesser amount in order for the pivot arm 280 to contact the body plate 229.

In addition to an adjustable shoe 276, the third exemplary guitar tremolo bridge comprises a bolt 282 for adjusting the cam member 244. The bolt 282 is rotatable in a first direction F and second direction G such that tightening it in its first direction F raises the cam member 244. When the cam member 244 is raised the tremolo arm 222 must overcome additional resistance to rotate. Conversely, when the bolt 282 is rotated in its second direction G the cam member 244 is lowered and the tremolo arm 222 must overcome less resistance to rotate.

Figure 17:
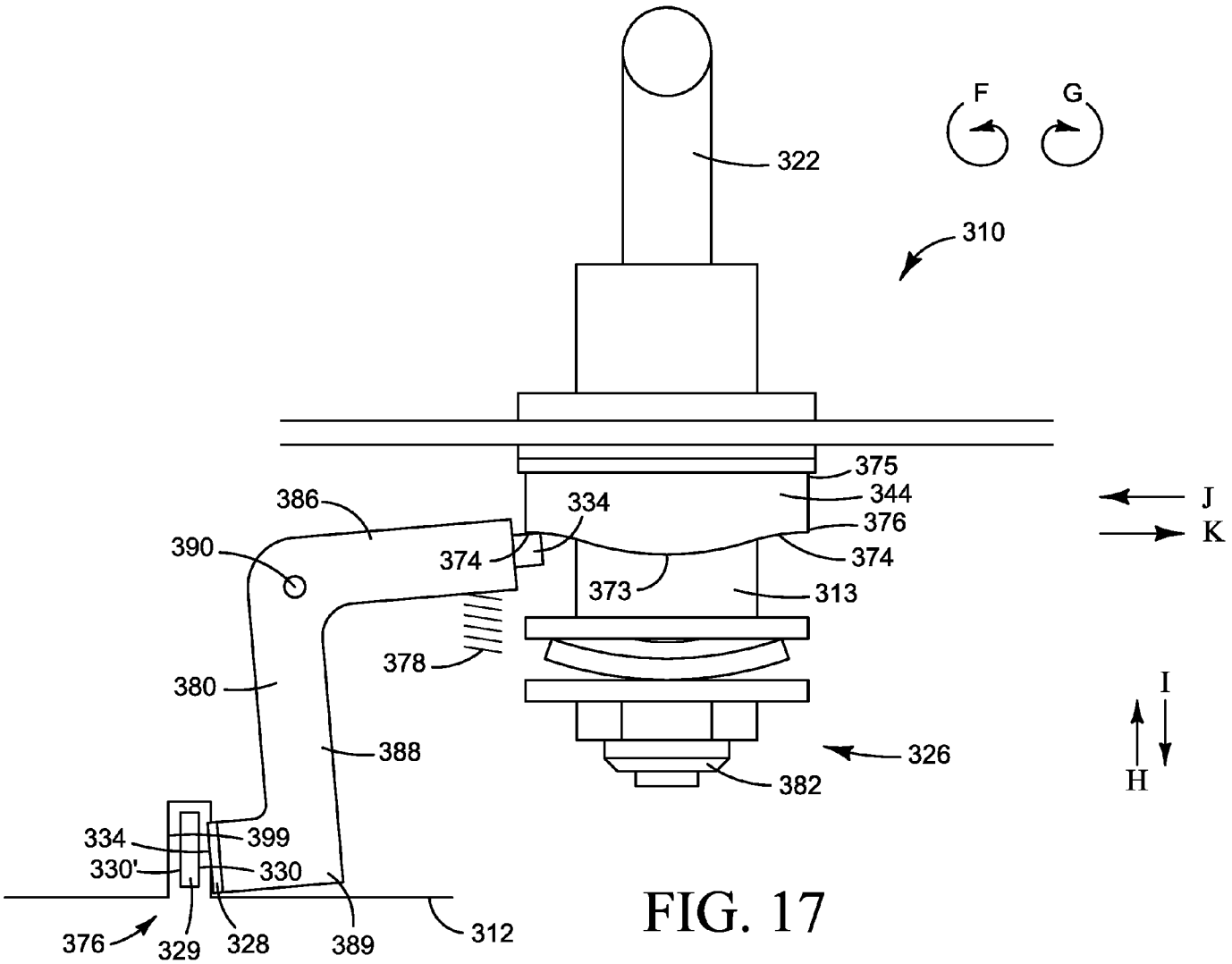
FIG. 17 is a partial, side elevation view of the fourth exemplary guitar tremolo bridge illustrating the unlocked position.
Figure 18:
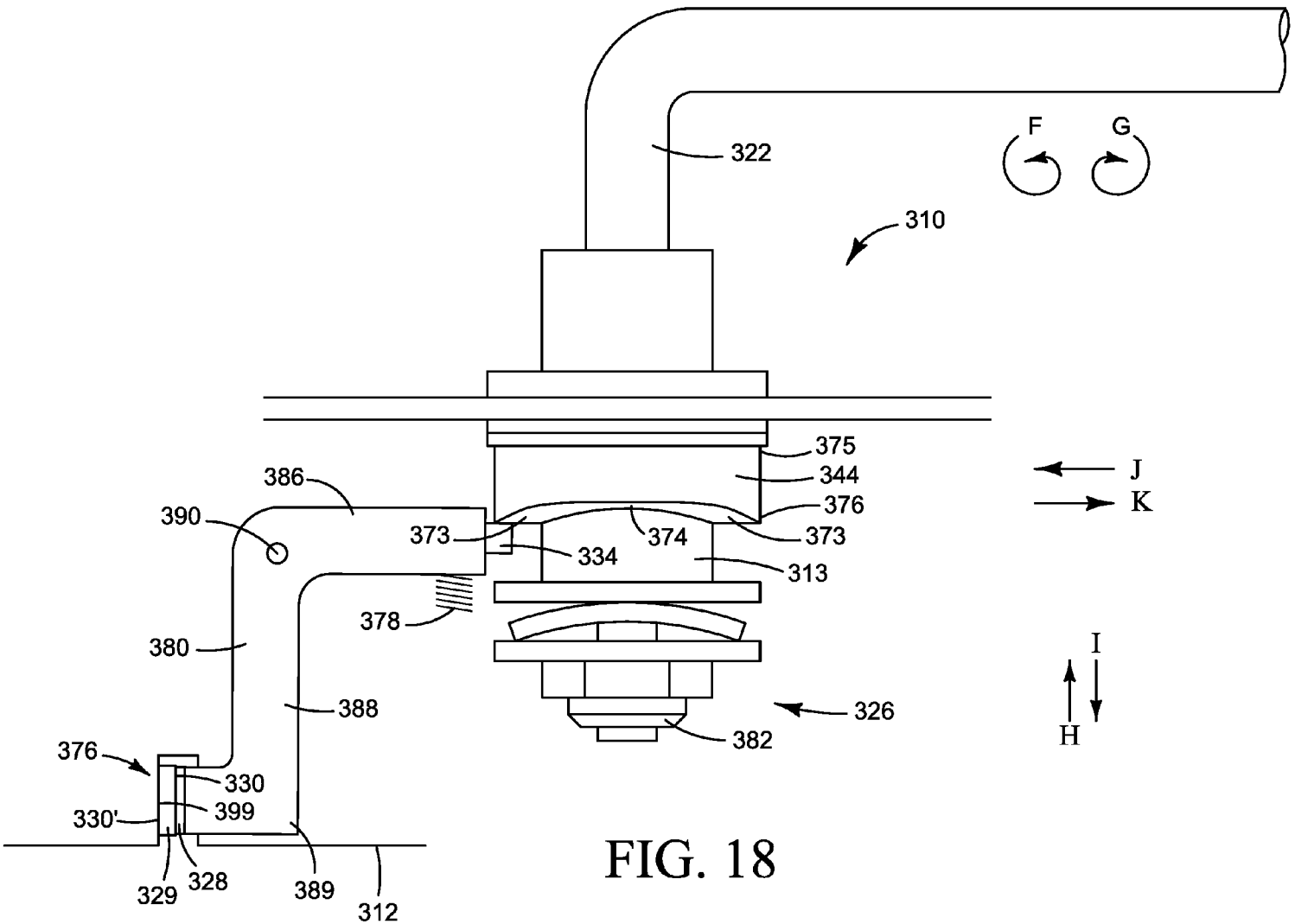
FIG. 18 is a partial, side elevation view of the fourth exemplary guitar tremolo bridge of FIG. 17, illustrating the locked position.

Referring now to FIGS. 17 and 18, the fourth exemplary guitar tremolo bridge 310 is illustrated. The fourth exemplary guitar tremolo bridge 310 is similar to the third exemplary guitar tremolo bridge 210 illustrated in FIGS. 14 through 16 and described above, except as detailed below. Thus, the fourth exemplar guitar tremolo bridge 310 includes a block 312, a shaft 313, a tremolo arm 322, a locking mechanism 326, a pressure pin 328, a body plate 329, a contact surface 330, a tip 334, a cam member 344, a rise 373, an adjustable shoe 376, a spring 378, a pivot arm 380, a bolt 382, a first leg 386, a second leg 388, a third leg 389, and a pivot connection 390.

The fourth exemplary guitar tremolo bridge 310 is configured in a manner opposite the third exemplary guitar tremolo bridge 210, with the cam member 344 having a second side 375 which is proximal to the tremolo arm 322, and a first side 376 which is distal from the tremolo arm 322. Referring initially to FIG. 18, the cam member 344 has an end cam shape, having a rise 373 and a dwell 374 on the first side 376 of the cam member 344. When the tremolo arm 322 of the fourth exemplary guitar tremolo bridge 310 is rotated in a first direction F the shaft 313, too, is rotated in a first direction F. This movement rotates the cam member 344 such that the tip 334, which is biased (upwards vertical force H) by spring 378 against the cam member 334, moves to the rise 373. As it moves into this position, the pivot arm 380 rotates about its pivoted connection 390, the tip 334 exerts a downward vertical force I on the spring 378 and the pressure pin 328 exerts a horizontal force K on the contact surface 330 of the body plate 329, forcing the opposite side surface 330' of the body plate 329 against the block contact surface 399. This horizontal force K holds the tremolo bridge 310 in its then-current position. Conversely, as illustrated in FIG. 17, when the tremolo arm 322 is rotated in a second direction G the shaft 313, too, is rotated in a second direction G. This movement rotates the rise 373 of the cam member 344 out from the tip 334, causing the tip 334 to rest in the dwell 374. When the tip 334 rests in the dwell 374, the spring 378 exerts an upward vertical force H on the first leg 386 and the pressure pin 328 retracts from the body plate 329, moving in direction J, allowing the tremolo bridge 310 to float freely.

Figure 19:
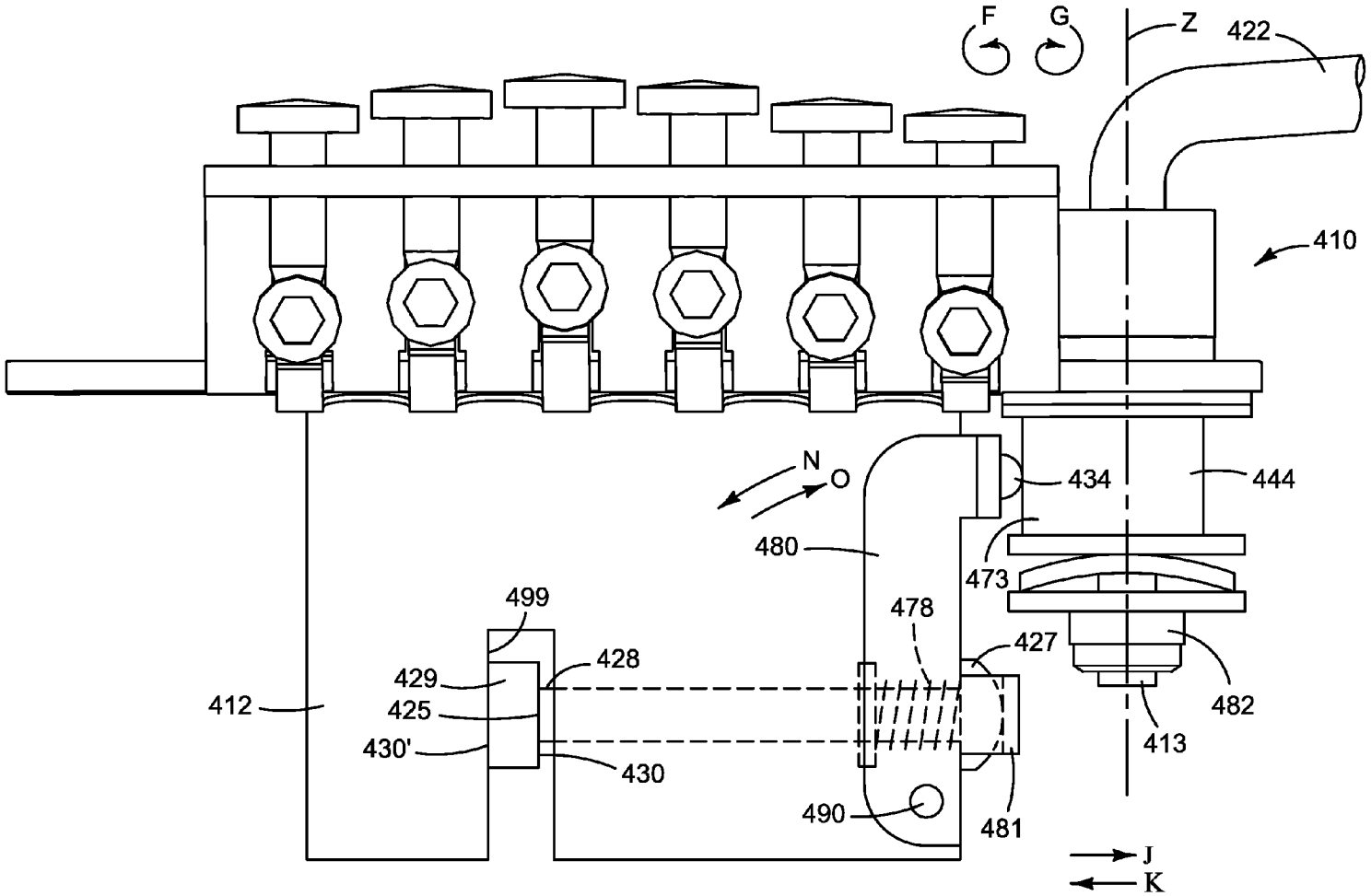
FIG. 19 is a partial, rear side view of a fifth exemplary guitar tremolo bridge illustrating the locked position.
Figure 20:
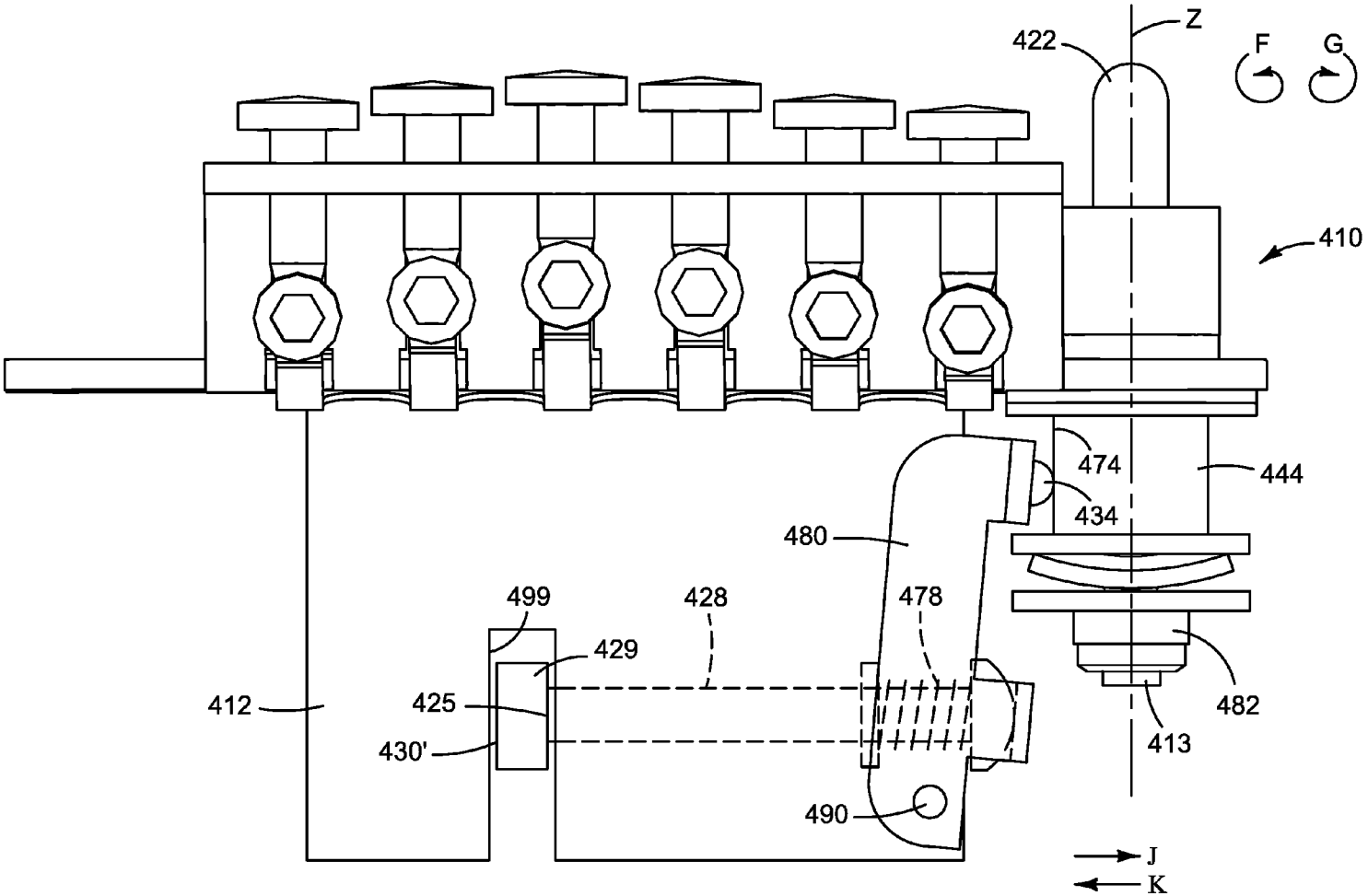
FIG. 20 is a partial, rear side view of the fifth exemplary guitar tremolo bridge of FIG. 19, illustrating the unlocked position.

Referring now to FIGS. 19 and 20 the fifth exemplary guitar tremolo bridge 410 is illustrated. The fifth exemplary guitar tremolo bridge 410 is similar to the third exemplary guitar tremolo bridge 210 illustrated in FIGS. 14 through 16 and described above, except as detailed below. Thus, the fifth exemplary guitar tremolo bridge 410 includes a block 412, shaft 413, tremolo arm 422, pressure pin 428, body plate 429, contact surface 430, 430', tip 434, cam member 444, rise 473, pivot arm 480, bolt 482, pivoted connection 490, and block contact surface 499.

The fifth exemplary guitar tremolo bridge 410 is oriented horizontally manner when compared with the third exemplary guitar tremolo bridge 210. The cam member 444 of the fifth exemplary guitar tremolo bridge 410 has a portion offset from the axis Z of the shaft 413 defining a rise 473 and a dwell 474. As illustrated in FIG. 19, the tremolo arm 422 is rotated in a first direction F, the shaft 413, too, is rotated in a first direction F. This movement rotates the cam member 444 such that the rise 473 exerts a horizontal force in direction K on the tip 434 attached to the pivot arm 480. When a force in direction J is exerted on the tip 434 by its contact with the rise 473, the pivot arm 480 rotates about its pivoted connection 490 in direction N. Rotation of the pivot arm 480 in direction N moves the extension 481 of the pivot arm 480 relative to the head 427 of the pressure pin 428 generally in direction K, bringing the extension 481 into contact with the head, and resulting in the tail end 425 of the pressure pin 428 exerting a horizontal force on the contact surface 430 of the body plate 429, forcing the opposite side surface 430' of the body plate 429 against the block contact surface 499. This horizontal force holds the tremolo bridge 410 in its then-current position. Conversely, when the tremolo arm 422 is rotated in a second direction G the shaft 413, too, is rotated in a second direction G. This movement rotates the rise 473 of the cam member 444 away from the tip 434 and brings the tip 434 into the dwell 474, causing the pivot arm 480 to rotate in direction O, moving the extension 481 of the pivot arm 480 generally in direction J and away from contact with the head 427 of the pressure pin 428, resulting in the head 424 of the pressure pin 428 no longer applying pressure to the contact surface 430 to through pressure tip 425 the body plate 429. This configuration allows the tremolo bridge 422 to float freely.

Any suitable structure and/or material can be used for the components of exemplary guitar tremolo bridges, and a skilled artisan will be able to select an appropriate structure and material for the exemplary guitar tremolo bridge in a particular embodiment based on various considerations, including the intended use of the guitar, the intended arena within which the guitar will be used, and the equipment and/or accessories with which the guitar is intended to be used, among other considerations.

It is noted that all structure and features of the various described and illustrated embodiments can be combined in any suitable configuration for inclusion in an exemplary guitar tremolo bridge according to a particular embodiment. For example, an exemplary guitar tremolo bridge according a particular embodiment can include neither, one, or both of mechanical locks and electro-mechanical locks described above.

The foregoing detailed description provides exemplary embodiments of the invention and includes the best mode for practicing the invention. The description and illustration of these embodiments is intended only to provide examples of the invention, and not to limit the scope of the invention, or its protection, in any manner.

What is claimed is:

1. A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising:

a base plate including at least one pivot point, said at least one pivot point of said base plate engaging said V-shaped notch to allow for tilting movement of the tremolo bridge along an arc;

a block extending from said base plate;

at least one spring connecting said block to said body, said at least one spring for counter-balancing the tension of the strings of the guitar and maintaining the tremolo bridge in a default position;

a tremolo arm attached to said base plate, said tremolo arm having a first portion and a second portion, said first portion attached to said base plate and said second portion extending angularly from said first portion, said first portion defining a first portion axis along a length thereof, said tremolo arm being rotatable about a swing axis defined generally parallel to said first portion axis and connected to said base plate; and an adjustable locking mechanism for locking the position of the tremolo bridge relative to said arc, wherein said adjustable locking mechanism is configured for locking the position of the tremolo bridge relative to said arc when the tremolo bridge is not in the default position, said adjustable locking mechanism connected to said first portion of said tremolo arm whereby said tremolo arm is rotatable between an unlocked position in which said tremolo bridge is capable of tilting freely along said arc, and a locked position in which said tremolo bridge is locked and held in its then-current position relative to said arc, wherein said adjustable locking mechanism comprises a cam member attached about a shaft, wherein rotation of the tremolo arm causes rotation of the shaft and rotation of the cam member, wherein rotation of the cam member in a first direction causes the bridge to be locked relative to said arc, wherein rotation of the cam member in a second direction allows the bridge to be freely tilted along said arc.

2. The tremolo bridge of claim 1, further comprising a pivot arm having a first leg comprising a cam tip and a second leg comprising a pressure pin, said pivot arm pivoting around a pivot connection, said cam tip for engaging with the cam member.

3. The tremolo bridge of claim 2, wherein the cam member comprises a cam surface which serves as a contact point for the cam tip when the tremolo arm is in its engaged position, wherein the cam member is end cam shaped, comprising a dwell and a rise, the dwell and rise for serving as a contact point for the cam tip, wherein the dwell serves as a contact point for the cam tip when the tremolo arm is in its disengaged position, and wherein the rise serves as a contact point for the cam tip when the tremolo arm is in its engaged position.

4. The tremolo bridge of claim 3, wherein the cam tip extends from the pivot arm such that rotation of the tremolo arm rotates the shaft which, in turn, rotates the cam member, wherein this rotation causes the cam tip to either rest on the rise, or rest in the dwell.

5. The tremolo bridge of claim 4, wherein when the cam tip is engaged with the dwell, pivot arm is disengaged from a body plate attached to the body, wherein this allows the tremolo bridge to free-float, and conversely, when the cam tip is engaged with the rise, the pivot arm engages the body plate, causing the tremolo bridge to be fixed in its then-current position.

6. The tremolo bridge of claim 5, wherein the body plate has a first side surface defining a first contact surface, and a second side surface defining a second contact surface, wherein the body plate is configured for receipt between a pressure pin tip and a contact surface of the block.

7. The tremolo bridge of claim 6, wherein the pivot arm is generally L-shaped, comprising a first leg and second leg, wherein said first leg comprises said cam tip, and wherein the second leg comprises a pressure pin extending therefrom.

8. The tremolo bridge of claim 7, wherein the pivot arm is pivotally mounted to the block by a pivoted connection, wherein vertical movement of the first leg causes horizontal movement of the second leg and horizontal movement of the second leg causes vertical movement of the first leg, thus, when exerting an upward vertical force on the cam tip then the second leg extends in a first horizontal direction, affixing the pressure pin to the body plate.

9. The tremolo bridge of claim 8, wherein when the tremolo arm is rotated in a first direction, the shaft is rotated in a first direction, this movement rotates the cam member such that the cam tip rests on the rise resulting in an upward vertical force being exerted upon the cam tip, causing a horizontal reaction by the pressure pin in a first horizontal direction, this horizontal force causes the pressure pin to come into contact with contact surface of the body plate, forcing the opposite side surface of the body plate against a block contact surface, locking the tremolo bridge in its then-current position; and wherein, when the tremolo arm is rotated in a second direction the shaft is rotated in a second direction, this movement rotates the cam member, causing the cam tip, biased by a spring, to rest in the dwell, causing a horizontal reaction by the pressure pin in a second horizontal direction, this second horizontal reaction causes the pressure pin to retract from the body plate, allowing the tremolo bridge to float freely.

10. The tremolo bridge of claim 6, wherein the pivot arm is generally S-shaped, comprising a first leg, a second leg, and a third leg, wherein said first leg comprises said cam tip, and wherein the third leg comprises a pressure pin extending therefrom.

11. The tremolo bridge of claim 10, wherein the pivot arm is pivotally mounted to the block by a pivoted connection, wherein vertical movement of the first leg causes horizontal movement of the third leg and horizontal movement of the third leg causes vertical movement of the first leg, thus, when exerting an upward vertical force on the cam tip the third leg extends in a first horizontal direction, affixing the pressure pin to the body plate.

12. The tremolo bridge of claim 11, wherein when the tremolo arm is rotated in a first direction, the shaft is rotated in a first direction, this movement rotates the cam member such that the cam tip rests on the rise resulting in an downward vertical force being exerted upon the cam tip, causing a horizontal reaction by the pressure pin in a first horizontal direction, this horizontal force causes the pressure pin to come into contact with contact surface of the body plate, forcing the opposite side surface of the body plate against a block contact surface, locking the tremolo bridge in its then-current position; and wherein, when the tremolo arm is rotated in a second direction the shaft is rotated in a second direction, this movement rotates the cam member, causing the cam tip, biased by a spring, to rest in the dwell, causing a horizontal reaction by the pressure pin in a second horizontal direction, this second horizontal reaction causes the pressure pin to retract from the body plate, allowing the tremolo bridge to float freely.

13. The tremolo bridge of claim 1, further comprising a pivot arm comprising a cam tip and a pressure pin, said pivot arm pivoting around a pivot connection, said cam tip for engaging with the cam member.

14. The tremolo bridge of claim 13, wherein the cam member comprises a cam surface which serves as a contact point for the cam tip when the tremolo arm is in its engaged position, wherein the cam member is disc cam shaped, comprising a dwell and a rise, the dwell and rise for serving as a contact point for the cam tip, wherein the dwell serves as a contact point for the cam tip when the tremolo arm is in its disengaged position, and wherein the rise serves as a contact point for the cam tip when the tremolo arm is in its engaged position.

15. The tremolo bridge of claim 14, further comprising a pivot arm comprising said cam tip and a pressure pin, wherein the cam tip extends from the pivot arm such that rotation of the tremolo arm rotates the shaft which, in turn, rotates the cam member, wherein this rotation causes the cam tip to either rest on the rise, or rest in the dwell.

16. The tremolo bridge of claim 15, wherein when the cam tip is engaged with the dwell, pivot arm is disengaged from a body plate attached to the body, wherein this allows the tremolo bridge to free-float, and conversely, when the cam tip is engaged with the rise, the pivot arm engages the body plate, causing the tremolo bridge to be fixed in its then-current position.

17. The tremolo bridge of claim 16, wherein the body plate has a first side surface defining a first contact surface, and a second side surface defining a second contact surface, wherein the body plate is configured for receipt between a pressure pin tip and a block contact surface.

18. The tremolo bridge of claim 17, wherein when the tremolo arm is rotated in a first direction, the shaft is rotated in a first direction, this movement rotates the cam member such that the cam tip rests on the rise resulting in a horizontal force being exerted upon the cam tip, causing a horizontal reaction by the pressure pin in a first horizontal direction, this horizontal force causes the pressure pin tip to come into contact with contact surface of the body plate, forcing the opposite side surface of the body plate against the block contact surface, locking the tremolo bridge in its then-current position; and wherein, when the tremolo arm is rotated in a second direction the shaft is rotated in a second direction, this movement rotates the cam member, causing the cam tip, biased by a spring, to rest in the dwell, causing a horizontal reaction by the pressure pin in a second horizontal direction, this second horizontal reaction causes the pressure pin tip to retract from the body plate, allowing the tremolo bridge to float freely.

19. A tremolo bridge for a guitar comprising a body, a neck attached to said body, a headstock attached to said neck, a plurality of tuners disposed on said headstock and adjacent the neck, at least one post extending from said body, each of said at least one post further comprising a V-shaped notch, and a plurality of strings, whereby each string of said plurality of strings is attached to the tremolo bridge, extends along the neck of the guitar, and is attached to a corresponding one of said plurality of tuners disposed on the headstock, said tremolo bridge comprising:

a base plate including at least one pivot point, said at least one pivot point of said base plate engaging said V-shaped notch to allow for tilting movement of the tremolo bridge along an arc;

a block extending from said base plate;

at least one spring connecting said block to said body, said at least one spring for counter-balancing the tension of the strings of the guitar and maintaining the tremolo bridge in a default position;

a tremolo arm attached to said base plate, said tremolo arm having a first portion and a second portion, said first portion attached to said base plate and said second portion extending angularly from said first portion, said first portion defining a first portion axis along a length thereof, said tremolo arm being rotatable about a swing axis defined generally parallel to said first portion axis and connected to said base plate;

a sensor for generating a signal, said sensor capable of transmitting said signal, said sensor capable of being placed in a locked position and an unlocked position, said locked position capable of locking said tremolo bridge in its then-current position relative to said arc, said unlocked position capable of allowing said tremolo bridge to tilt freely along said arc;

an adjustable locking mechanism for locking said tremolo bridge in a fixed position relative to said arc, said adjustable locking mechanism comprising an electronic actuator for receiving said signal, said electronic actuator operably connected to said sensor, said electronic actuator capable of moving in an engaging direction in response to said signal, said electronic actuator capable of moving in a disengaging direction in response to said signal, said electronic actuator further comprising a biasing portion for biasing said electronic actuator in said disengaging direction, wherein placing said sensor into said unlocked position causes said electronic actuator to disengage, allowing said biasing portion to cause the electronic actuator to disengage from said locked position; and wherein said adjustable locking mechanism is configured for locking the position of the tremolo bridge relative to said arc when the tremolo bridge is not in the default position, said adjustable locking mechanism connected to said first portion of said tremolo arm whereby said tremolo arm is rotatable between an unlocked position in which said tremolo bridge is capable of tilting freely along said arc, and a locked position in which said tremolo bridge is locked and held in its then-current position relative to said arc.

20. The tremolo bridge of claim 19, wherein said sensor is a touch sensor.

* * * * *